US011519125B2

(12) United States Patent
Wang

(10) Patent No.: US 11,519,125 B2
(45) Date of Patent: Dec. 6, 2022

(54) DOOR LOCK

(71) Applicant: Illinois Tool Works Inc., Glenview, IL (US)

(72) Inventor: Yang Wang, Dongguan (CN)

(73) Assignee: Illinois Tool Works Inc., Glenview, IL (US)

( * ) Notice: Subject to any disclaimer, the term of this patent is extended or adjusted under 35 U.S.C. 154(b) by 728 days.

(21) Appl. No.: 16/315,355

(22) PCT Filed: Jul. 4, 2017

(86) PCT No.: PCT/CN2017/091621
§ 371 (c)(1),
(2) Date: Jan. 4, 2019

(87) PCT Pub. No.: WO2018/006790
PCT Pub. Date: Jan. 11, 2018

(65) Prior Publication Data

US 2019/0309542 A1 Oct. 10, 2019

(30) Foreign Application Priority Data

Jul. 6, 2016 (CN) ..... 201610525155.6
Dec. 8, 2016 (CN) ..... 201611122616.1

(51) Int. Cl.
*D06F 39/14* (2006.01)
*E05B 17/00* (2006.01)
(Continued)

(52) U.S. Cl.
CPC ..... *D06F 39/14* (2013.01); *E05B 17/0041* (2013.01); *E05B 63/22* (2013.01);
(Continued)

(58) Field of Classification Search
CPC ..... Y10T 292/1077; Y10T 292/0863; Y10T 292/0948; Y10T 292/0951;
(Continued)

(56) References Cited

U.S. PATENT DOCUMENTS 5,401,067 A * 3/1995 Kurosaki ..... E05C 5/00 292/63
5,498,039 A * 3/1996 Bivens ..... B60N 3/08 292/145
(Continued)

FOREIGN PATENT DOCUMENTS

CN 1249387 A 4/2000
CN 201103056 Y 8/2008
(Continued)

OTHER PUBLICATIONS

International Search Report for PCT/CN2017/091621.

*Primary Examiner* — Kristina R Fulton
*Assistant Examiner* — Steven A Tullia
(74) *Attorney, Agent, or Firm* — Boyle Fredrickson, S.C.

(57) ABSTRACT

The present disclosure discloses a door lock, comprising a cam having a notch, wherein the door hook is fixed in the cam when a door hook mounted on the door is inserted into the notch of the cam; driving means actuated by a push force from outside of the door, a pull force from outside of the door, a push from inside of the door, or by a control signal, wherein the driving means moves the cam from a locked position to an unlocked position.

15 Claims, 16 Drawing Sheets

(51) Int. Cl.
*E05B 63/22* (2006.01)
*E05C 3/12* (2006.01)
*A47L 15/42* (2006.01)

(52) U.S. Cl.
CPC ..... *E05C 3/12* (2013.01); *A47L 15/4259* (2013.01); *E05Y 2900/30* (2013.01)

(58) Field of Classification Search
CPC ..... Y10T 292/0956; Y10T 292/1005; Y10T 292/1028; Y10T 292/1043; Y10T 292/1047; Y10T 292/1051; Y10T 292/1061; Y10T 292/1078; Y10T 292/082; Y10T 292/1083; Y10T 292/1084; Y10T 292/432; E05B 63/22; E05B 17/0041; E05B 17/20; E05B 17/2007; E05B 17/2038; E05B 17/2057; E05C 3/12; E05C 5/00; A47L 15/4259; D06F 39/14; D06F 37/28; E05Y 2900/30
See application file for complete search history.

(56) References Cited

U.S. PATENT DOCUMENTS

| | | | | | |
|---|---|---|---|---|---|
| 6,056,333 | A * | 5/2000 | Wach | E05C 19/022 | 292/137 |
| 6,669,248 | B2 * | 12/2003 | Shirase | B60N 3/102 | 292/300 |
| 6,702,340 | B2 * | 3/2004 | Donald | G06K 9/00087 | 292/109 |
| 7,775,565 | B2 * | 8/2010 | Hartmann | E05C 3/24 | 292/60 |
| 2003/0116974 | A1 * | 6/2003 | Cole | F24C 15/022 | 292/110 |
| 2005/0194795 | A1 * | 9/2005 | Hapke | E05B 17/0025 | 292/216 |
| 2014/0265378 | A1 | 9/2014 | Lee | | |

FOREIGN PATENT DOCUMENTS

| | | | | | |
|---|---|---|---|---|---|
| CN | 102094305 | A | | 6/2011 | |
| CN | 104746303 | A | | 7/2015 | |
| CN | 104805645 | A | | 7/2015 | |
| CN | 204552361 | U | | 8/2015 | |
| CN | 105386277 | A | * | 3/2016 | A47L 15/4259 |
| DE | 19846863 | A1 | * | 4/2000 | E05B 47/0009 |
| DE | 102006058322 | A1 | * | 6/2008 | A47L 15/4259 |
| DE | 202015100627 | U1 | * | 4/2015 | E05B 47/0603 |
| DE | 102015201944 | A1 | * | 9/2015 | E05C 3/24 |
| EP | 2087829 | A1 | | 8/2009 | |
| EP | 2450510 | A2 | * | 5/2012 | D06F 37/42 |
| FR | 1232021 | A | | 10/1960 | |
| JP | 1998272293 | A | | 10/1998 | |
| JP | 2011120902 | A | | 6/2011 | |
| KR | 20100125071 | A | * | 11/2010 | E05B 47/0603 |
| KR | 20140098956 | A | * | 8/2014 | D06F 37/42 |
| WO | 2013181289 | A1 | | 5/2013 | |
| WO | WO-2015140306 | A1 | * | 9/2015 | A47L 15/4259 |
| WO | WO-2015189668 | A1 | * | 12/2015 | E05C 3/24 |

* cited by examiner

DOOR LOCK

TECHNICAL FIELD

The present disclosure generally relates to a door lock for an electrical equipment (e.g., a washing machine, a dish washer, etc.), and more particularly to a door lock with which a door of an electrical equipment (e.g., a washing machine, a dish washer, etc.) is able to be opened through a plurality of ways.

BACKGROUND

A door lock mechanism may be used for controlling locking or opening a door of an electrical equipment (e.g., a washing machine, a dish washer, etc.).

There are multiple aspects of requirements on the door lock mechanism of the electrical equipment for its normal use. For example, it is required to provide a user with various ways for conveniently opening the door of the electrical equipment and meanwhile guarantee reliable running of the electrical equipment in various conditions. In addition, the door lock mechanisms for some commercial or household appliances need to be equipped with a safe mechanism for protecting children. For example, for a door lock mechanism of a front-loading washing machine with a door provided at the front side of the machine, when a child accidentally enters the drum of the front-loading washing machine, the closed door should be able to be pushed open from the inside with a relatively small force, such that the child can come out from the drum of the washing machine.

The present disclosure intends to provide a door lock mechanism that satisfies the above requirements.

SUMMARY

In order to satisfy various requirements on a door lock mechanism, the present disclosure provides a door lock structure that enables a user to lock and open a door by performing push-push or push-pull action from outside (or outer side) of the door, enables a user to open the door by performing push action from inside (or internal side) of the door after the door is locked, and enables to open the door automatically. Technical solutions of the door lock structure according to the present disclosure are provided below:

According to a first aspect of the present disclosure, a door lock is provided which comprises a cam and driving means.

The cam has a notch, when a door hook mounted on a door is inserted into the notch of the cam, the door hook is fixed in the cam.

The driving means is actuated by a push force from outside of the door, a pull force from outside of the door, a push force from inside of the door, or by a control signal. The driving means moves the cam from a locked position to an unlocked position.

According to a second aspect of the present disclosure, a door lock is provided which comprises a cam and driving means.

The cam has a notch, when a door hook mounted on the door is inserted into the notch of the cam, the door hook is fixed in the cam.

The driving means is actuated by a push force from outside of the door, a pull force from outside of the door, or a push force from inside of the door. The driving means moves the cam from a locked position to an unlocked position.

In one embodiment of the door lock according to the second aspect, the driving means comprises a sliding block and a rocking block.

The sliding block abuts against the cam and reciprocates with rotation of the cam, wherein when the sliding block is located at a side abutting against the door hook, the door hook is secured at the locked position; and when unlocked, the sliding block may be moved to a side away from the door hook, thereby causing the cam to release the door hook.

The rocking block is mounted on the sliding block, wherein the rocking block has a mechanism that may retain the cam in the locked position or the unlocked position.

Wherein the rocking block may be in a rotatable operating state or a non-rotatable state.

In one embodiment of the door lock according to the second aspect, the rocking block comprises a rocking block locking mechanism.

The rocking block locking mechanism locks the rocking block to make it non-rotatable or releases the rocking block to make it rotatable.

In one embodiment of the door lock according to the second aspect, the rocking block further comprises a heart shaped groove.

The heart shaped groove having a first position (point B) corresponding to the locked position and a second position (point A) corresponding to the unlocked position.

In one embodiment of the door lock according to the second aspect, the rocking block locking mechanism comprises a roller, a spring guide rod, and a spring.

Wherein the spring is sleeved on the spring guide rod and provides an elastic force to the roller;

Wherein the rocking block has a spring bore.

Wherein the spring, the spring guide rod, and the roller are mounted in the spring bore.

In one embodiment of the door lock according to the second aspect, the sliding block is provided with a receiving cavity, a stepped protrusion being provided in the receiving cavity.

When the roller extends out of the rocking block and contacts with the stepped protrusion, the stepped protrusion engages with the roller to prevent the rocking block from rotating.

In one embodiment of the door lock according to the second aspect, the driving means further comprises a sliding mechanism.

A pin is provided on the sliding mechanism.

Wherein the heart shaped groove is provided above the sliding mechanism.

Wherein the pin is inserted into the heart shaped groove, the pin moves between the locked position (point B) and the unlocked position (point A) in the heart shaped groove.

In one embodiment of the door lock according to the second aspect, the driving means further comprises a base.

The sliding mechanism is mounted on the base;

The rocking block has a raised portion, and the base has a protrusion.

Wherein the raised portion of the rocking block and the protrusion of the base cooperate with each other to restore the rocking block to an eccentrically rotated position.

In one embodiment of the door lock according to the second aspect, a torsion spring is provided on the cam, such that when the cam is in an unlocked position, the torsion spring ejects the door hook.

In one embodiment of the door lock according to the second aspect, the driving means further comprises automatic unlocking means.

When actuated by a signal, the driving means moves the cam from the locked position to the unlocked position.

In one embodiment of the door lock according to the second aspect, the automatic unlocking means comprises an operating rod and an actuator.

The operating rod is used for pressing the roller on the rocking block into the interior of the rocking block;

The actuator is used for actuating the operating rod.

In one embodiment of the door lock according to the second aspect, the door lock further comprises a reset spring.

The reset spring is mounted on the sliding block for resetting the sliding block, Wherein an elastic force of the torsion spring on the cam is greater than an elastic force of the reset spring on the sliding block.

The door lock according to the second aspect comprises a buffer mechanism for buffering an external force applied when the door lock is in a locked state.

In one embodiment of the door lock according to the second aspect, the buffer mechanism comprises a lever plate, a lever shaft, and a lever spring.

The lever plate comprises an upper portion, a middle portion, and a lower portion;

A back of the middle portion of the lever plate is bent into an indentation for receiving the lever shaft;

The sliding mechanism comprises a sliding plate, the sliding plate having a round disc;

The upper portion is proximate to an edge of the round disc of the sliding plate.

The door lock according to the present disclosure uses a rocking block to control the sliding block to lock or release a cam and then control locking and unlocking of the door lock. Meanwhile, the rocking block may be in a rotatable state or a non-rotatable state; when the rocking block rotates, the door lock may be opened by push or pull with external force or by push from the inside of the door of the electric appliance. Further, a separate actuator may be provided to lock and release the rocking block, causing the rocking block to rotate to release the cam, thereby achieving the objective of unlocking. In addition, the present disclosure provides a buffer mechanism so as to absorb an undesired displacement, which causes failure of the actuator, of the sliding block when driven by an external force.

BRIEF DESCRIPTION OF THE DRAWINGS

FIG. 7A-2 is a schematic diagram showing a relative position between the pin 303 and a heart shaped groove 411 of the rocking block 401 in the state as shown in FIG. 7A-1;

FIG. 7B-1 is a sectional view of the door lock 100 viewed from a lateral side thereof, showing a structural and state diagram when the door hook 101 is inserted into a cam 201 but not locked yet according to the present disclosure;

FIG. 7B-2 is a schematic diagram showing a relative position between the pin 303 and the heart shaped groove 411 of the rocking block 401 in the state as shown in FIG. 7B-1;

FIG. 7C-1 is a sectional view of the door lock 100 viewed from a lateral side thereof, showing a structural and state diagram when the door hook 101 is inserted into the cam 201 and locked according to the present disclosure;

FIG. 7C-2 is a schematic diagram showing a relative position between the pin 303 and the heart shaped groove 411 of the rocking block 401 in the state as shown in FIG. 7C-1;

FIGS. 8A-1, 8A-2, 8B-1, and 8B-2 show a process of opening the door lock by an external pull force or by an interior push force;

DETAILED DESCRIPTION OF EMBODIMENTS

Figure 1A:
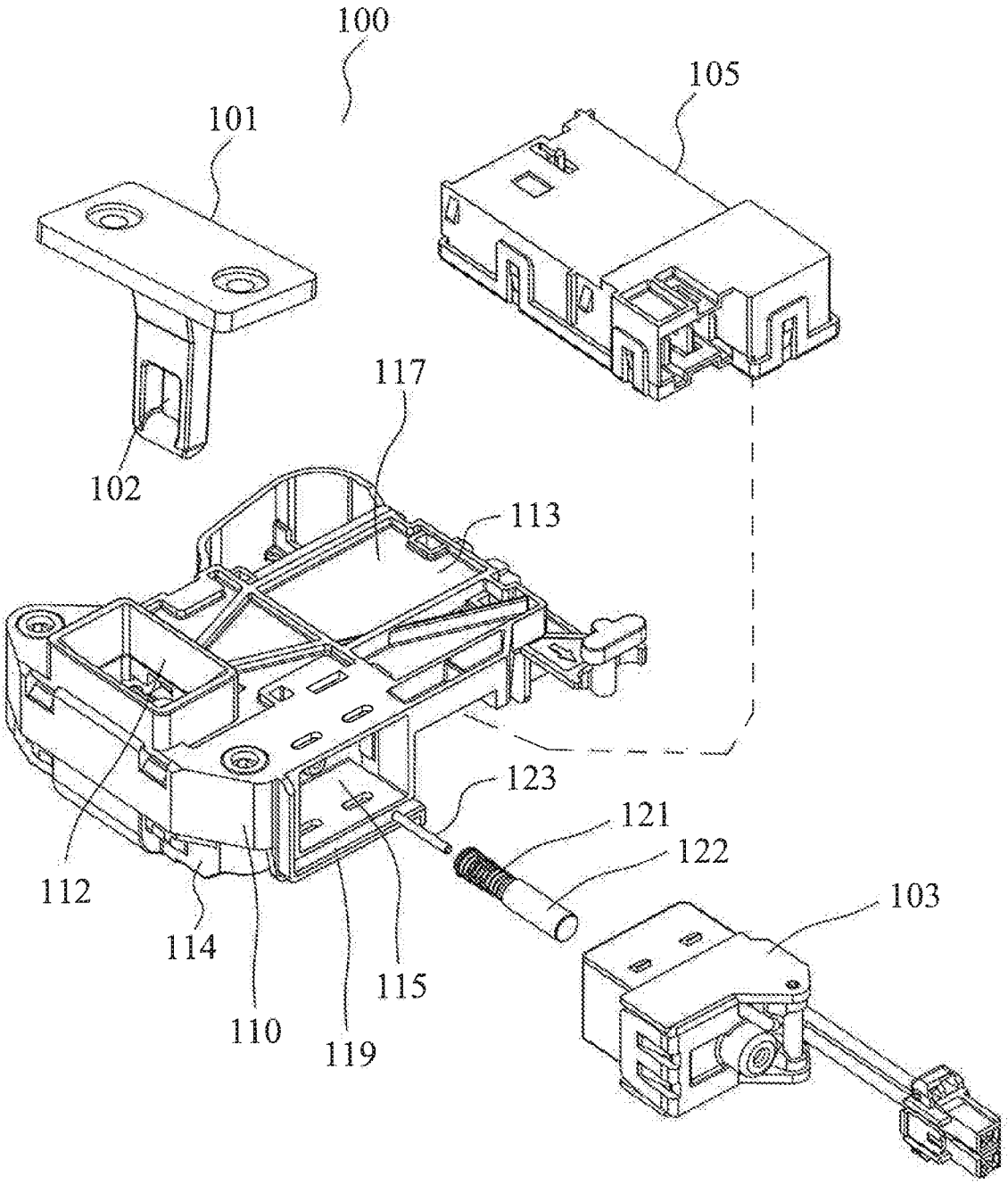
FIG. 1A is a general structural diagram viewed from a front side of a door lock 100 according to the present disclosure and illustrates some parts of the door lock 100 through an exploded view.

Hereinafter, various embodiments of the present disclosure will be described with reference to the drawings which constitute part of the specification. It should be understood that although terms indicating directions (e.g., "front," "back," "above," "below," "left," "right," "head," "tail,"

etc.) are used herein to describe various exemplary structural portions and elements of the present disclosure, they are used only for illustration purposes and determined based on exemplary orientations shown in the drawings. Since the embodiments disclosed in the present disclosure may be provided according to different directions, these terms indicating the directions are only illustrative, not for limiting. In possible scenarios, same or similar reference numerals used in the present disclosure refer to the same components.

Figure 1B:
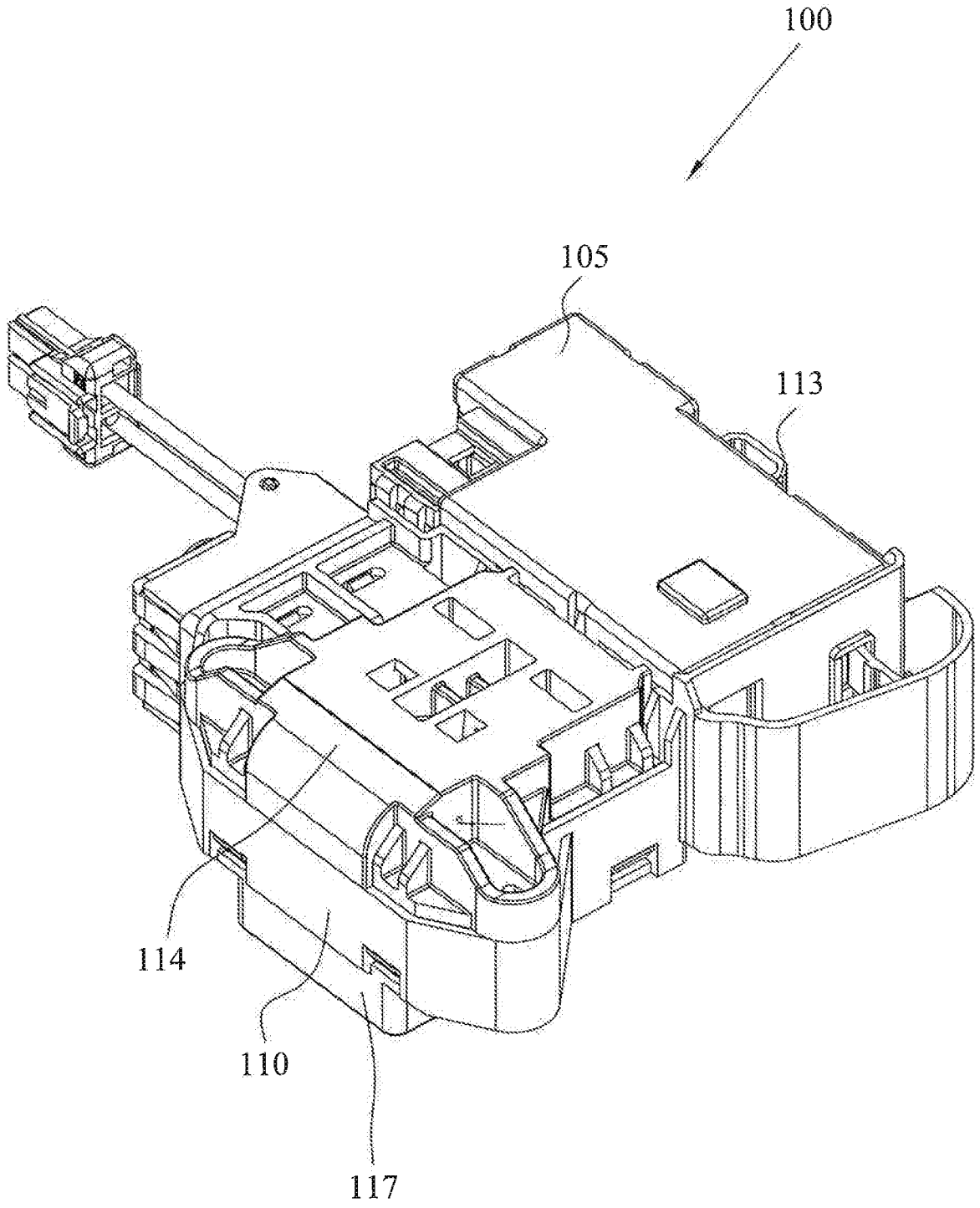
FIG. 1B is a general structural diagram viewed from a back side of the door lock 100 according to the present disclosure.

FIG. 1A is a general structural diagram viewed from a front side of a door lock 100 according to the present disclosure and show some parts of the door lock 100 through an exploded view. FIG. 1B is a general structural diagram viewed from a back side of the door lock 100 according to the present disclosure.

As illustrated in FIG. 1A, the door lock 100 comprises a door lock case 110, the door lock case 110 is provided with an upper cover 117 on an upper portion thereof, and the door lock upper cover 117 is provided with a door lock hole 112 on a head side thereof for receiving a door hook 101. The door hook 101 is disposed above the door lock hole 112 and hooked with a cam (see the cam 201 in FIG. 2) inside the door lock 100 when the door hook 101 is inserted into an interior of the door lock 100 from the door lock hole 112 above the door lock body 110, such that when the cam is locked, the door of the electric appliance is also locked.

In FIG. 1A, the door lock 100 further comprises an actuator 103 and a switch box 105. A bottom surface 119 is provided below the head side of the door lock upper cover 117, a receiving cavity 115 is formed between the upper cover 117 and the bottom surface 119, and the actuator 103 is received in the receiving cavity 115. The actuator 103 is an electromagnetic driving part (see FIG. 6) provided with a reset spring 121, an iron core 122, and a contact needle 123 arranged at the front. After the actuator 103 receives an actuation signal, its internal coil (see coil 104 in FIG. 6) is energized to generate an electromagnetic push force to the icon core 122 to eject the contact needle 123. After de-energizing, the contact needle 123 is retracted back. With reference to the figures below and the description for the figures, it is seen that the contact needle 123 operates as follows: when the contact needle 123 is ejected, the contact needle 123 pushes an operating rod 433 (see FIG. 4) in a sliding block 204 to cause a rocking block 401 in the sliding block 204 to be in a rotatable state.

The switch box 105 is mounted below a tail side of the upper cover 117. It is seen from the figures below and the descriptions for the figures that the switch box 105 mainly functions to lock or release the sliding block 204 and switch on/off a main circuit for controlling the door lock 100.

As illustrated in FIG. 1B, a base 114 is provided below the head side of the lock body upper cover 117, the switch box 105 is provided below the tail side of the upper cover 117 of the lock body, and the base 114 and the switch box 105 are adjacently disposed below the upper cover 117 along a width direction of the door lock body 110.

Figure 2:
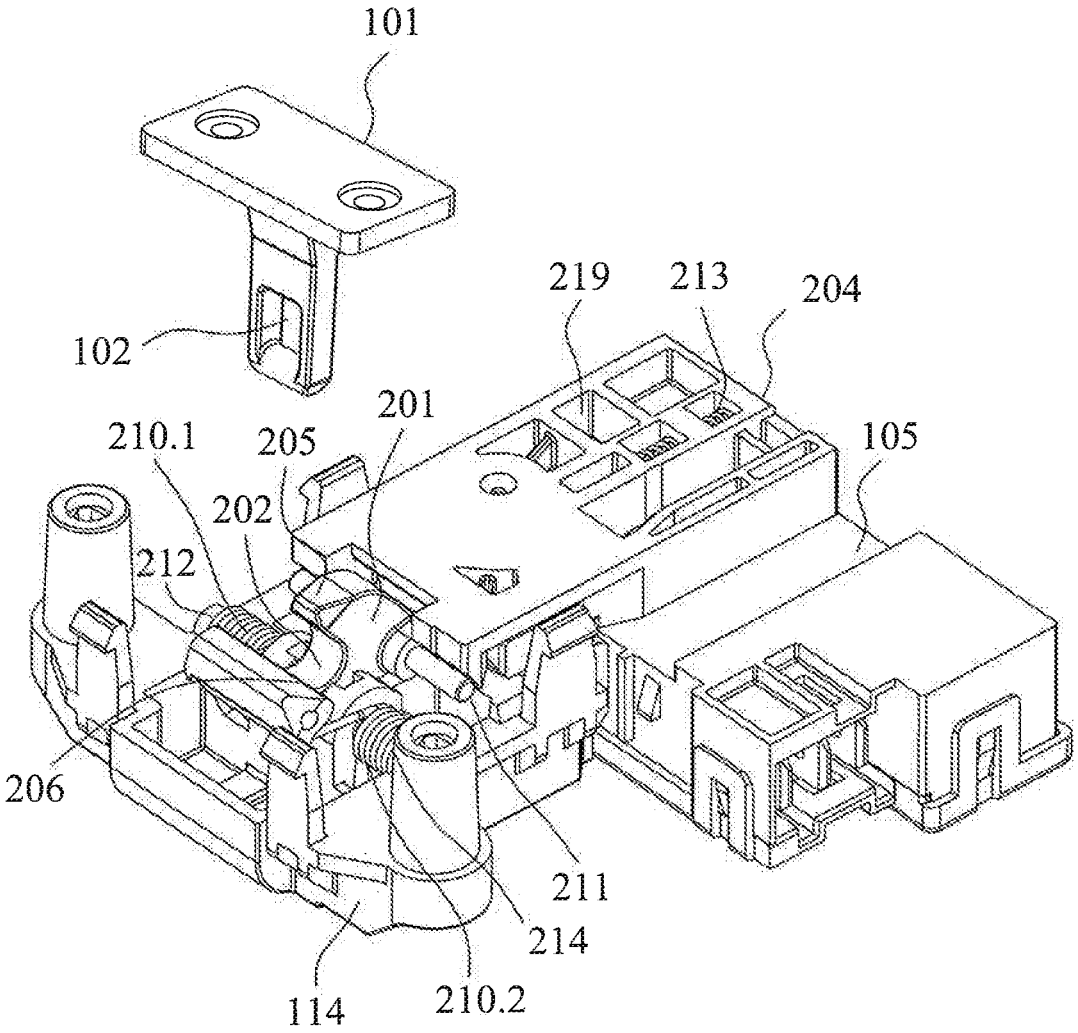
FIG. 2 is a structural diagram of the door lock 100 in FIG. 1A after removing an upper cover 117 and removing an actuator 103.

FIG. 2 is a structural diagram of the door lock 100 in FIG. 1A after removing the upper cover 117 and removing the actuator 103, for showing more specifically the components in the base 114, the switch box 105, and the sliding block 204, as well as the relationships among the base 114, the switch box 105, and the sliding block 204.

In FIG. 2, the base 114 and the switch box 105 are adjacently disposed side by side below the upper cover 117 along the width direction of the door lock case 110. The sliding block 204 is disposed between the upper cover 117 and the switch box 105 and across the base 114 and the switch box 105 along the width direction of the door lock case 110 with a head of the sliding block 204 covering a portion of the area above the base 114. A locking hole 219 is provided on the sliding block 204, such that when a locking block (see the locking block 1101 in FIG. 11) in the switch box 105 extends out and is inserted into the locking hole 219, the sliding block 204 is locked.

As shown in FIG. 2, the cam 201 is provided on the base 114 and disposed below the door hook 201. The cam 201 has a body with a crescent-shaped curved structure and having an arc-shaped notch 202, an upper end of which is a hook 205. After the door hook 101 is inserted into the door lock hole 112, the door hook 101 pushes the cam 201 to rotate and the rotation of the cam 201 causes the hook 205 to be inserted into a hole 102 of the door hook 101 to catch the door hook 101. A lower end 206 of the notch 202 is able to contact a front end of the door hook 101, such that when the door hook 101 is inserted, the front end of the door hook 101 abuts against the lower end 206 of the notch 202 to push the cam 201 to rotate counterclockwise.

The cam 201 is fixed on the base 114 through circular shafts 212 and 214 arranged at two sides thereof, such that the cam 201 is able to rotate about the circular shafts 212 and 214. The circular shafts 212 and 214 are sleeved with torsion springs 210 including a torsion spring 210.1 and a torsion spring 210.2 at each of the two sides. The torsion springs 210 provide a torsion force to reset the cam 201. When the door hook 101 is extracted out of the cam 201, the torsion springs 210.1 and 210.2 drive the cam 201 to rotate clockwise. The cam 201 is also provided with cam pins 211 on two sides of a tail end (i.e., a distal end away from the opening of the notch 202) thereof, and the cam pins 211 abut against a left end of the sliding block 204. Meanwhile, the torsion springs 210 provide a biasing force for opening the door, namely, when the cam 201 and the sliding block 204 are in an unlocked position, the torsion springs 210 eject the door hook 101 out of the cam 201.

FIG. 2 shows a front side of the sliding block 204. A reset spring 213 is provided at a tail end of the sliding block 204, wherein a torsion force of the torsion spring 210 on the cam 201 is larger than an elastic force of the reset spring 213 on the sliding block 204. Due to interaction between the reset spring 213 and the torsion spring 210, when the cam 201 is making a rotational movement, the sliding block 204 reciprocates therewith. Specifically, the reset spring 213 provides a pretension force causing the slide bock 204 to abut against the cam pins 211 on the cam 201, while the torsion springs 210 provide a push force causing the cam 201 to rotate counterclockwise. In this way, the torsion spring 210 cooperates with the reset spring 213 such that when the cam 201 rotates clockwise or counterclockwise, the contact between the back side of the cam 201 and the sliding block 204 causes the sliding block 204 to generate a corresponding reciprocating movement.

Figure 3A:
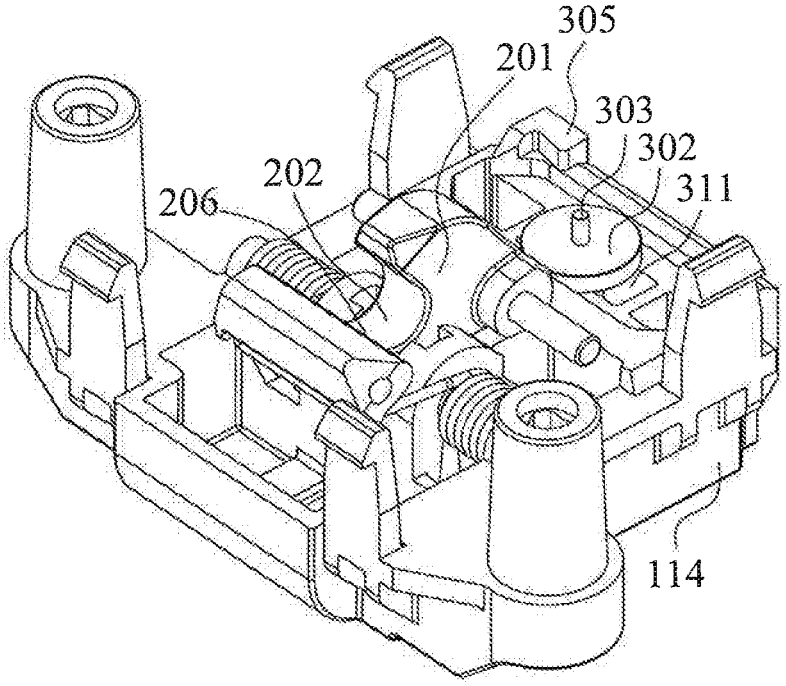
FIG. 3A is a structural diagram showing a base 114 in FIG. 2 after separating it from a sliding block 204 and a switch box 105.

FIG. 3A is a structural diagram showing the base 114 in FIG. 2 after separating it from the sliding block 204 and the switch box 105, for more specifically showing components provided on the base 114, as well as relationships among these components.

It is seen from FIG. 3A that the base 114 is provided with a transverse groove 311 for receiving a sliding plate 302 which is capable of moving transversely along the transverse groove 311. Upon an operation of closing and opening the door by push-push, the transverse movement of the sliding plate 302 along the transverse groove 311 causes a pin 303 to transversely move within a heart shaped groove 411. When it is needed to buffer the movement of the sliding block 204, the sliding plate 302 may move along a width direction of the transverse groove 311 (see FIG. 13D); when it is not needed to buffer the movement of the sliding block 204, movement of the sliding plate 302 along the width direction of the transverse groove 311 is restricted (see FIG. 13C). The pin 303 (its internal structure is specifically shown in FIG. 3B) is provided on the sliding plate 302, a lower end of the pin 303 is inserted into a hole of a round disc 321, while an upper end of the pin 303 is inserted into the heart shaped groove 411 of the rocking block 401 in the sliding block 204 (see FIG. 4C). The base 114 is also provided with a protrusion 305 at a corner (left corner in the rear) thereof, and the protrusion 305 cooperates with a raised portion 420 of the rocking block 401 (see FIG. 4C) to restore the rocking block 401 to a position where it is not eccentrically rotated (see FIGS. 10A-10B).

Figure 3B:
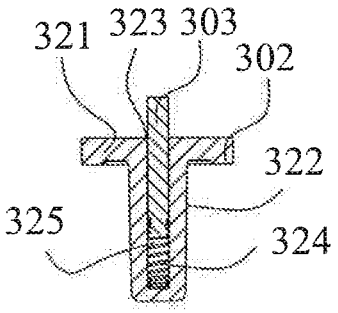
FIG. 3B is a structural diagram of a pin 303 according to the present disclosure, showing a more detailed structure of the pin 303.

FIG. 3B is a structural diagram of the pin 303 according to the present disclosure, showing a more detailed structure of the pin 303.

As shown in FIG. 3B, the sliding plate 302 comprises a round disc 321 and a sleeve 322. The sleeve 322 extends from one side of the round disc 321 and is provided with a receiving cavity 325 having a closed bottom. The round disc 321 is provided with a plug-hole 323 at the center thereof in communication with the receiving cavity 325. The pin (steel needle) 303 can be inserted in the plug-hole 323 and a spring 324 is provided between one end (the tail end) of the pin 303 and an inner bottom of the sleeve 322. Because the heart shaped groove 411 disposed on the sliding block 204 is located above the sliding plate 302, the lower end of the pin 303 on the sliding plate 302 is inserted in the heart shaped groove 411 of the rocking block 401 (see FIG. 5A). An elastic force of the spring 324 in the sleeve 322 enables the steel pin 303 to move up and down and by adjusting a height of the pin 303 extending out of the round disc 321 dependent on the depth change of the heart shaped groove 411, such that the pin 303 will always in contact with the bottom of the heart shaped groove 411. A relative position relationship between the pin 303 and the heart shaped groove 411 reflects the operation states of the sliding block 204 and the cam 201.

Figure 4A:
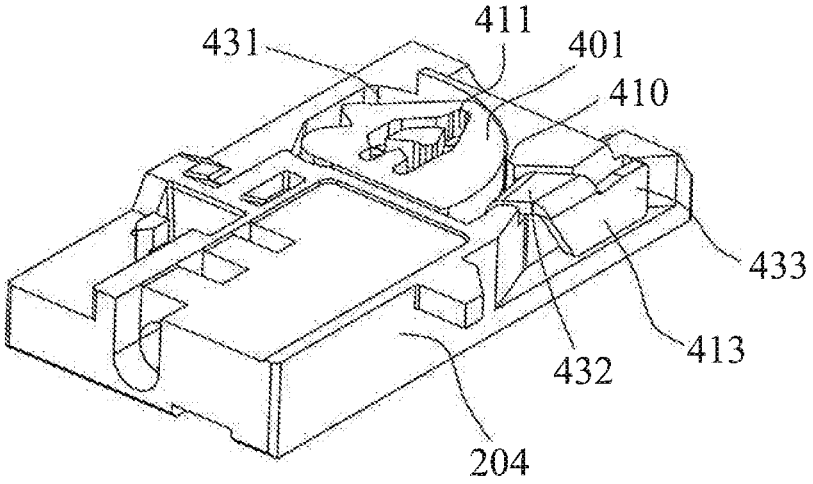
FIG. 4A is a structural diagram of a back side of the sliding block 204.
Figure 4B:
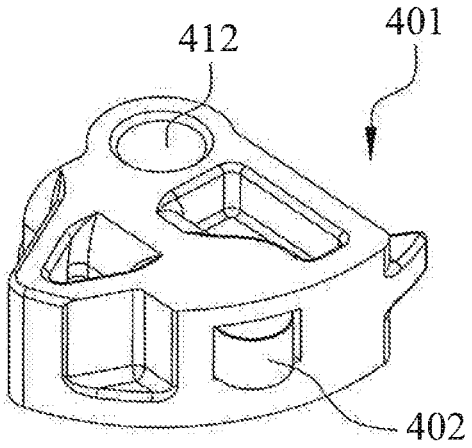
FIG. 4B is a structural diagram of a back side of a rocking block 401 according to the present disclosure.
Figure 4C:
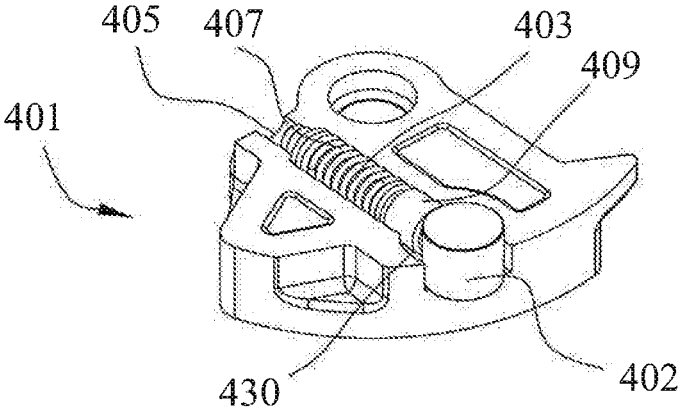
FIG. 4C is a sectional view of the rocking block 401 according to the present disclosure.
Figure 4D:
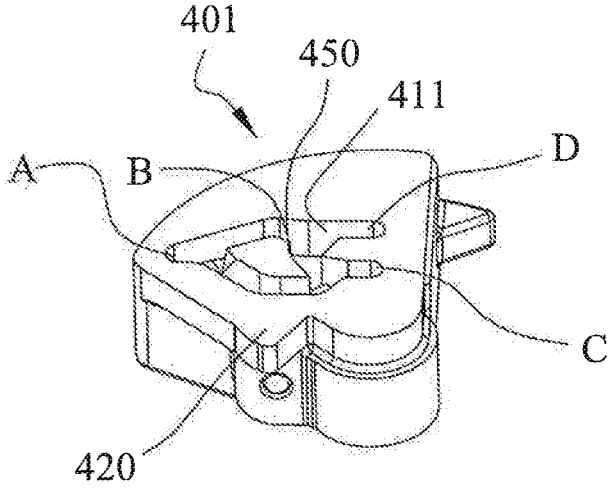
FIG. 4D is a structural diagram of a front side of the rocking block 401 according to the present disclosure.

FIG. 4A is a structural diagram of a back side of the sliding block 204. FIG. 4B is a structural diagram of a back side of the rocking block 401 according to the present disclosure, showing the structure of the back side of the rocking block 401. FIG. 4C is a sectional view of the rocking block 401 according to the present disclosure, for more clearly showing a locking mechanism inside the rocking block 401. FIG. 4D is a structural diagram of a front side of the rocking block 401 according to the present disclosure, for more clearly showing the heart shaped groove structure 411.

As shown in FIG. 4A, the sliding block 204 is provided with a receiving cavity 431 for receiving the rocking block 401 which is rotatable inside the receiving cavity 431. By means of a rotation locking mechanism (see a roller 402 and a rod 403) on the rocking block 401, the rocking block 401 may be configured in a rotatable state and a non-rotatable state in the receiving cavity 431. In the present disclosure, operations of opening and closing the door by push-pull or an automatic operation of opening the door may be implemented when the rocking block 401 is in the rotatable state, while operations of opening and closing the door by push-push may be implemented when the rocking block 401 is in the non-rotatable state.

Figure 5A:
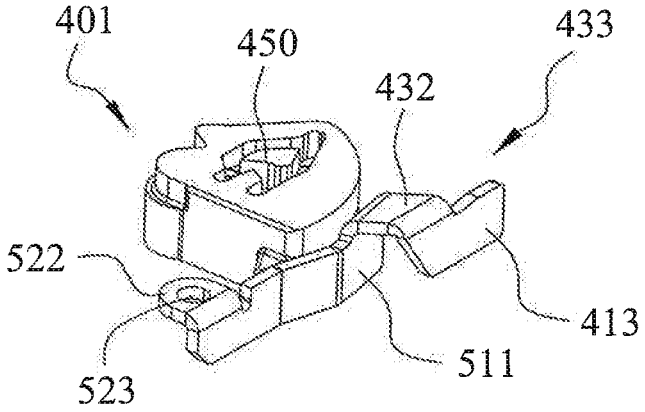
FIG. 5A is a structural diagram showing the rocking block 401 and an operating rod 433 in FIG. 4A after separating them from the sliding block 204.
Figure 5B:
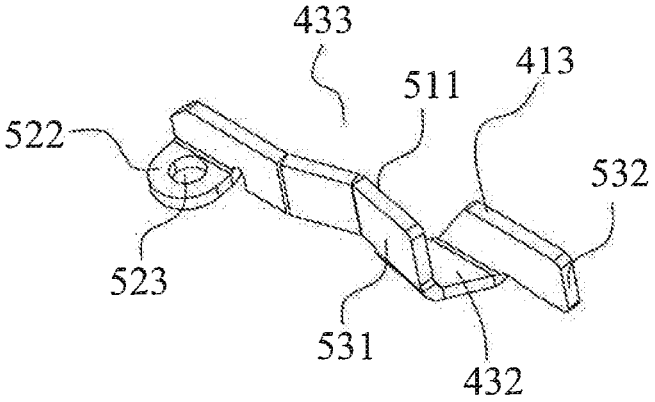
FIG. 5B is a structural diagram of a back side of the operating rod 433.
Figure 6:
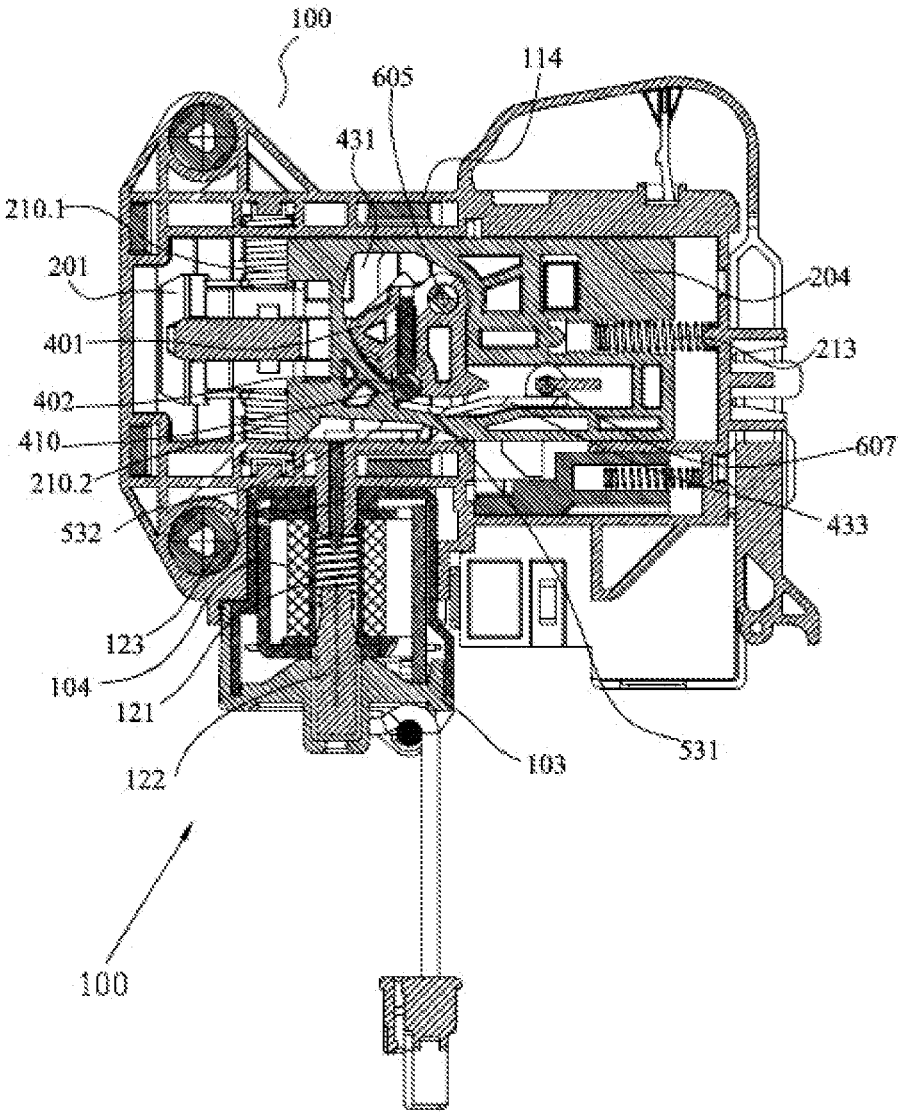
FIG. 6 is a sectional view of the general structure of the door lock according to the present disclosure.

The rocking block 401 is rotatably fixed within the receiving cavity 431 through a shaft extending through a circular hole 412 at one end of the back side of the rocking block 401 (see the shaft 605 in FIG. 6). When the roller 402 is engaged on a stepped protrusion 410 at an edge of the receiving cavity 431 to catch the rocking block 401, the rocking block 401 is in the non-rotatable state. When the roller 402 is retracted into the interior of the receiving cavity 430, the stepped protrusion 410 loses its catching force for the roller 402 such that the rocking block 401 is in the rotatable state and the rocking block may be eccentrically rotated. Because the roller 402 extends out through the elastic force of the spring 407, when the force causing the rocking block 401 to rotate generated by pulling or pushing the door is greater than the elastic force of the spring 407, the roller 402 will be pressed back into the receiving cavity 430 such that the rocking block 401 may rotate. Further, when an external force is directly applied on the roller 402 to press the roller 402 back into the receiving cavity 430, the rocking block 401 may rotate as well. An operating rod 433 is provided at one side of the receiving cavity 431 on the sliding block, and the operating rod 433 can directly apply a force to the roller 402 when it is swinging so as to press the roller 402 back into the receiving cavity 430 to make the rocking block 401 rotatable. The structure of the operating rod 433 is specifically shown in FIGS. 5B-5C.

As shown in FIG. 4B, the rocking block 401 is generally of a fan-shaped structure. The circular hole 412 is provided at an end of the fan-shaped structure, and the shaft (see shaft 605 in FIG. 6) is provided at a bottom of the receiving cavity 431 of the sliding block 204, wherein the circular hole 412 is sleeved on the shaft 605 such that the rocking block 401 is rotatably fixed in the receiving cavity (see the receiving cavity 431 in FIG. 4A) inside the sliding block 204 via the hole 412. In FIG. 4B, the roller 402 extending out of a part of the edge of the rocking block 401 can be seen. The structure inside the rocking block 401 for controlling the roller 402 can be seen in the sectional view of the rocking block 401 in FIG. 4C.

As shown in FIG. 4C, the cut rocking block 401 exposes the internal structure of the rocking block 401. As shown in FIG. 4C, the rocking block 401 is provided with a spring bore 405 therein. A receiving cavity 430 is provided inside the spring bore 405 close to an edge of the rocking block 401 for receiving the roller 402. Part of the roller 402 extends out from the receiving cavity 430 when it is not subjected to an external force. A spring guide rod 403, the spring 407, and the sleeve 409 are disposed in the spring bore 405. The proximal end of the spring guide rod 403 is connected to the roller 402, and the spring 407 and the sleeve 409 are sleeved on the spring guide rod 403. The sleeve 409 is disposed between the spring 407 and the roller 402, with one end of the sleeve 409 being in contact with the spring 407 and the other end of the sleeve 409 being in contact with the roller 402.

In the present embodiment, the roller 402 may reciprocate along the spring bore 405 in the receiving cavity 430 such that the roller 402 can extend out of the receiving cavity 430 and thus extends out of the edge of the rocking block 401, or the roller 402 can be retracted into the interior of the receiving cavity 430 and thus retracted inside the edge of the rocking block 401. Without an external force, the roller 402 is abutted by the spring 407 in the rear, part of the roller 402 extends out of the edge of the rocking block 401 and engages with the stepped protrusion (see the stepped protrusion 410 in FIG. 4A) at the edge of the receiving cavity in the sliding block 204, such that the rocking block 401 is fixed (see FIG. 9A), and then the rocking block 401 is in the non-rotatable operating state. With an external force, the external force acts to press the roller 402. When the external force overcomes the elastic force of the spring 407, the roller 402 is retracted into the interior of the receiving cavity 430, and the stepped protrusion 410 releases the rocking block 401 such that the rocking block 401 is in the rotatable operating state. To those skilled in the art, the roller 402 may also be a roll ball or other structure.

As shown in FIG. 4D, the rocking block 401 is generally of a fan-shaped structure. A front side of the rocking block 401 is provided with the heart shaped groove 411. Two stable points (i.e., a heart tip point A and a heart pit point B) are provided in the heart shaped groove 411, wherein the heart tip point A corresponds to an unlocked position while the heart pit point B corresponds to an locked position. In addition, two non-stable positions are provided in the heart shaped groove 411, namely point C (a first transition position) and point D (a second transition position). Because the heart pit B has a recessed portion 450, when the pin 303 is located at the recessed portion 450 of the heart pit point B, movement of the pin 303 is restricted, such that the sliding block 204 cannot move either. In other words, when the pin 303 is located at the recessed portion 450 of the heart pit point B, the pin 303 has to move out of the recessed portion 450 of the heart pit point B so as to enable the pin 303 to be in a slidable state in the heart shaped groove 411.

When the pin 303 moves in the heart shaped groove 411, a first movement path refers to moving from point A to point B, which passes the first transition position point C and then turns back to point B from the point C, and a second movement path refers to moving from point B to point A, which passes through the second transition point D and then turns back to point A from the point D. A transverse distance exists when the pin 303 moves from point B to point D or from point D to point A in the heart shaped groove 411, and there also exists a transverse distance when the pin 303 moves from point A to point C or from point C to point B in the heart shaped groove 411. Therefore, in the case that the rocking block 401 is in the non-rotatable state, when the pin 303 reciprocates in the heart shaped groove 411, the sliding plate 302 will make a corresponding transverse movement in the transverse groove 311.

In FIG. 4D, the rocking block 401 is also provided with the raised portion 420 at one side thereof. After the rocking block 401 is eccentrically rotated, the protrusion 305 abuts the raised portion 420 as the sliding block 204 moves in a direction away from the cam 201 and the protrusion 305 pokes the rocking block 401 back to the position where it is not eccentrically rotated through the force applied by the sliding block 204.

FIG. 5A is a structural diagram showing the rocking block 401 and the operating rod 433 after separating them from the sliding block 204 in FIG. 4A so as to better illustrate the positional relationship between the rocking block 401 and the operating rod 433. FIG. 5B is a more detailed structural diagram of the operating rod 433 according to the present disclosure.

As illustrated in FIG. 5A, the operating rod 433 has an inner side portion 511 and an outer side portion 413. The inner side portion 511 of the operating rod 433 is disposed facing the rocking block 401, namely, the inner side portion 511 of the operating rod 433 faces the side of the sliding block 401 having the roller 402. A proximal end of the inner side portion 511 of the operating rod 433 is provided with a lug 522 extending towards the rocking block 401, and the lug 522 is provided with a hole 523 therein. The hole 523 is mounted on a shaft inside the sliding block 204 (see the shaft 607 in FIG. 6), such that the operating rod 433 can rotate about the shaft 607. When the operating rod 433 rotates about the shaft 607 towards the roller 402, the inner side portion 511 of the operating rod 433 may directly apply a force to the roller 402 to push the roller 402 back into the receiving cavity 430 so as to enable the rocking block 401 to be in the rotatable state.

FIG. 5B shows a structural diagram of a back side of the operating rod 433.

As shown in FIG. 5B, a distal end of the inner side portion 511 of the operating rod is provided with a bridging portion 432 extending in a direction away from the rocking block 401, and the outer side portion 413 is provided at a distal side of the bridging portion 432. The outer side portion 413 of the operating rod 433 is provided with a front end 532 extending in a direction away from the hole 523. The inner side portion 511 of the operating rod has a contact portion 531 between the bridging portion 432 and the hole 523.

Further referring to FIG. 4A, the bridging portion 432 rides on a wall body of the receiving cavity 431, the inner side portion 511 of the operating rod is disposed within the receiving cavity 431 and contacts with the inner wall of the receiving cavity 431, the outer side portion 413 of the operating rod is disposed outside the receiving cavity 431 and contacts with the outer wall of the sliding block 204. As an external force pushes the front end 532, the operating rod 433 rotates such that the contact portion 531 may press the roller 402.

FIG. 6 is a sectional view of the general structure of the door lock according to the present disclosure, showing how the actuator 103 actuates the roller 402 in the rocking block 401.

FIG. 6 shows the cam 201 provided on the base 114 of the door lock 100, the torsion springs 210.1 and 210.2 at the two sides of the cam 201, the sliding block 204, the receiving cavity 431 on the sliding block 204, the rocking block 401 disposed in the receiving cavity 431, and the actuator 103. The actuator 103 is disposed at a side of the base 114 and the sliding block 204. The actuator 103 comprises the reset spring 121, the iron core 12.2, the contact needle 123, and the coil 104. A front end of the contact needle 123 is close to the front end 532 of the operating rod 433, the contact portion 531 of the operating rod 433 is close to the roller 402 that is engaged with the stepped protrusion 410 of the receiving cavity 431. When the actuator 103 is activated after receiving an electric signal, the coil 104 is energized. Due to the electromagnetic force generated by the coil 104, the iron core 122 is driven to move forward, causing the contact needle 123 to extend forwardly. Then, the contact needle 123 pushes the front end 532 of the operating rod 433, such that the contact portion 531 of the operating rod 433 presses the roller 402 to make it retract into the receiving cavity 430 and disengaged from the stepped protrusion 410 against the elastic three of the spring 403 in the rock block 401 so as to enable the rocking block 401 to be in the rotatable state.

Figures 1, 7A:
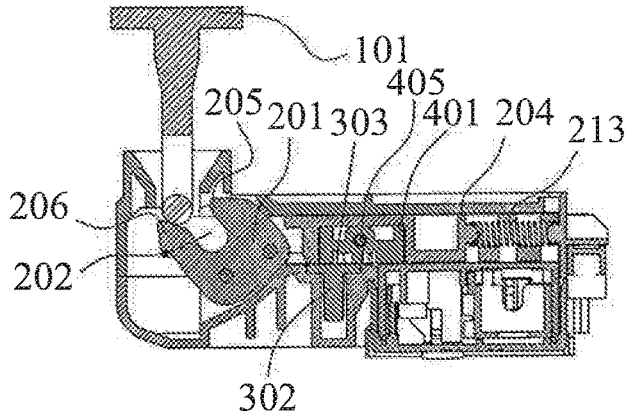
FIG. 7A-1 is a sectional view of the door lock 100 viewed from a lateral side thereof.
Figures 2, 7A:
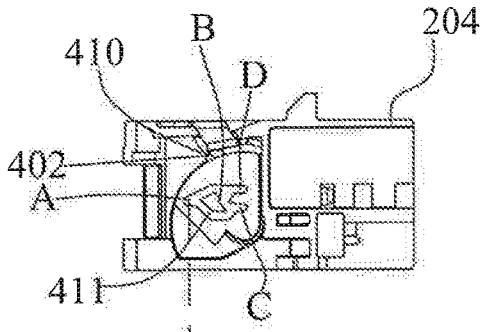

FIG. 7A-1 is a sectional view of the door lock 100 viewed from a lateral side thereof, showing the structural and state diagram when the door lock 101 has not yet been inserted into the cam 201. FIG. 7A-2 is a schematic diagram showing a relative position between the pin 303 and the heart shaped groove 411 of the rocking block 401 in the state as shown in FIG. 7A-1.

As shown in FIG. 7A-1, the door hook 101 is at a position away from the cam 201. At this point, the cam 201 is in a released position, the cam 201 has a tendency of rotating counterclockwise due to the elastic potential of the torsion spring 210, and the sliding block 204 is pushed to the right side (along a direction away from the cam 201) by the back side of the cam 201. The reset spring 213 in the sliding block 204 is in a compressed state, such that the sliding block 204 has a tendency of moving towards the cam 201. However, this movement tendency is blocked by the cam 201, such that the sliding block 204 and the cam 201 are at a relatively stable position, namely, the door lock 100 is at the unlocked position. At this point, as shown in FIG. 7A-2, the pin 303 is located at position A of the heart shaped groove 411 in the sliding block 204, and the rocking block 401 in the sliding block 204 is in the non-rotatable state because the roller 402 is caught by the stepped protrusion 410.

Figures 1, 7B:
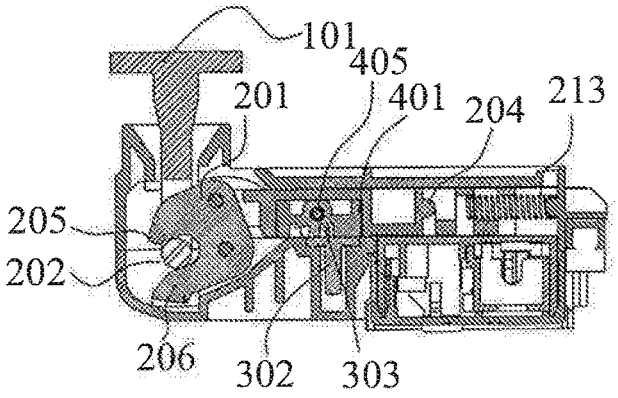
Figures 2, 7B:
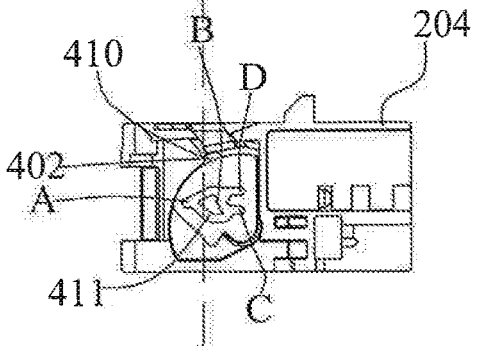

FIG. 7B-1 is a sectional view of the door lock 100 viewed from a lateral side thereof, showing a structural and state diagram during the door hook 101 is inserted into the cam 201 but not locked yet according to the present disclosure. FIG. 7B-2 is a schematic diagram showing a relative position between the pin 303 and the heart shaped groove 411 of the rocking block 401 in the state as shown in FIG. 7B-1.

As shown in FIG. 7B-1, to close the door, a push force is applied to the door from the outside of the door to move the door hook 101 towards the cam 201, and the front end of the door hook 101 will touch the lower end 206 of the cam 201 below the notch thereof. The push force generated when the door hook is inserted overcomes the torsion of the torsion spring 210 to push the cam 201 to rotate counterclockwise, and then the cam 201 moves from the position in FIG. 7A-1 to the position in FIG. 7B-1. As the hook 205 on the cam 201 rotates to be inserted into the slot 202 on the door hook 101, due to counterclockwise rotation of the cam 201, the force for supporting the cam 201 against the sliding block 204 disappears, such that the elastic force of the reset spring 213 of the sliding block 204 pushes the sliding block 204 to move towards the cam 201, the sliding block 204 drives the rocking block 401 to move relative to the pin 303, and the pin 303 moves from position A to position C along the first path at the lower part of the heart shaped groove 411.

Figures 1, 7C:
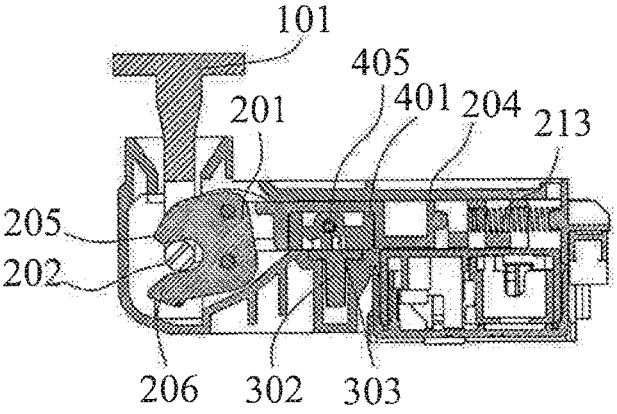
Figures 2, 7C:
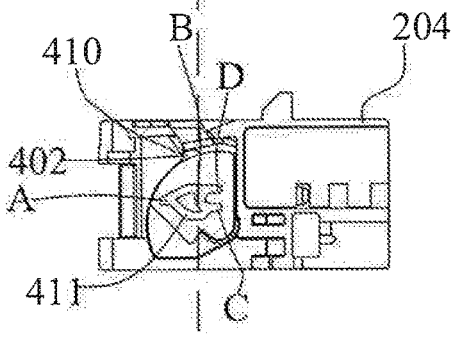

FIG. 7C-1 is a sectional view of the door lock 100 viewed from a lateral side thereof, showing a structural and state diagram when the door hook 101 is inserted into the cam 201 and locked. FIG. 7C-2 is a schematic diagram showing a relative position between the pin 303 and the heart shaped groove 411 of the rocking block 401 in the state as shown in FIG. 7C-1.

As shown in FIG. 7C-1, when the external push force disappears, the torsion of the torsion spring 210 forces the cam 201 to rotate clockwise by a small angle, the cam 201 pushes the sliding block 204 to move a distance to the right. Meanwhile, as shown in FIG. 7C-2, the heart shaped groove 411 turns back from point C to point B relative to the pin 303. Because the pin 303 is located in the recessed portion 450 at the pit point B, except the side facing the pin 303, the other three sides are all limited, the sliding block 204 thus cannot move to the right (the direction away from the cam 201). Moreover, because the sliding block 204 abuts against the back side of the cam 201, the cam 201 cannot rotate any more, and the hook 205 at the upper end of the cam 201 hooks the hole 102 of the door hook 101, thereby implementing a door locking operation.

It should be to be noted that as shown in the dotted lines in FIGS. 7A-2, 7B-2, and 7C-2, since the sliding plate 302 cannot move along the length direction of the sliding block 204 at this point (see FIG. 13C), the pin 303 cannot move along the length direction of the sliding block 204. Namely, the pin 303 does not move at this point, but the rocking block 401 moves. It is just the movement of the rocking block 401 that causes relative positional movement of the pin 303 with respect to the heart shaped groove 411.

FIG. 7B-1 can be also used to illustrate an operation of opening the door by an external push force. Specifically, after the door is locked, in order to normally unlock and open the door of the electric appliance by an external push force, the electric appliance needs to be in a power off state, and the switch box 105 shall release the sliding block 204. When the external force pushes the door hook 101, the cam 201 acts as shown in FIG. 7B-1. Specifically, the external push force causes the door hook 101 to push the cam 201, and the cam 201 will rotate a small angle counterclockwise, such that the cam 201 moves from the state shown in FIG. 7C-1 to that shown in FIG. 7B-1. In this way, the back side of the cam 201 moves towards a direction away from the sliding block 204 (i.e., to the left) and under the action of the push force of the spring 213 on the sliding block 204, the sliding block 204 moves a corresponding small distance towards the cam 201 (i.e., to the left), such that the pin 303 moves from point B to point D. Because the recessed portion 450 of point B moves in a direction away from the pin 303, the rocking block 401 cannot rotate. When the push force disappears, the torsion of the torsion spring 210 on the cam 201 overcomes the elastic force of the spring 213 on the sliding block 204 (i.e., the torsion of the torsion spring 210 on the cam 201 is larger than the elastic force of the spring 213 on the sliding block 204), causing the sliding block 204 to move to the right (along a direction away from the cam 201). Accordingly, the heart shaped groove 411 moves a corresponding distance to the right under the action of the torsion of the torsion spring 210, causing the pin 303 to turn back from point D to move to point A in the heart shaped groove 411 at which point the door lock is at a released position. Because a transverse distance exists when moving from point B to point D or from point D to point A in the heart shaped groove 411, when the rocking block 401 is in the non-rotatable state, the sliding plate 302 needs to make a corresponding transverse movement in the transverse groove 311 to enable the transverse movement of the pin 303 in the heart shaped groove 411.

Figures 1, 8A:
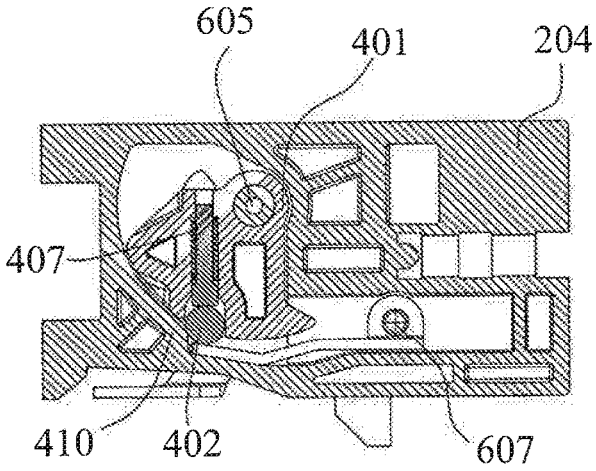
Figures 2, 8A:
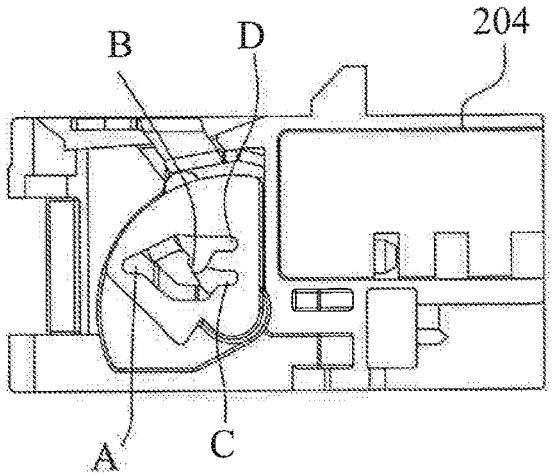

FIGS. 8A-1, 8A-2. 8B-1, and 8B-2 show a process of opening the door lock by an external pull force or an internal push force. FIG. 8A-1 is a sectional view of the sliding block 204, showing an operating state diagram of the internal structures of the sliding block 204 when the door hook 101 of the present disclosure is inserted into the cam 201 and the pin 303 is at point B position of the heart shaped groove 411. FIG. 8A-2 is a schematic diagram of a relative position between the pin 303 and the heart shaped groove 411 in the state as shown in FIG. 8A-1.

As shown in FIG. 8A-1, when the pin 303 is located at point B position of the heart shaped groove 411, the roller 402 in the rocking block 401 is caught by the stepped protrusion 410, and the rocking block 401 is not eccentrically rotated. As shown in FIG. 8A-2, at this moment, the pin 303 is located at point B of the heart shaped groove 411.

Figures 1, 8B:
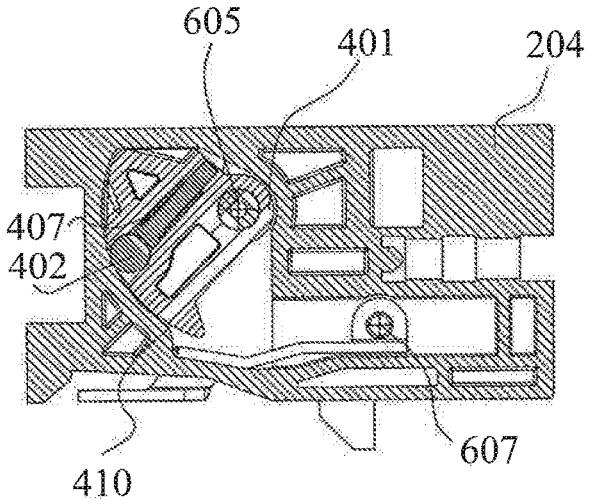
Figures 2, 8B:
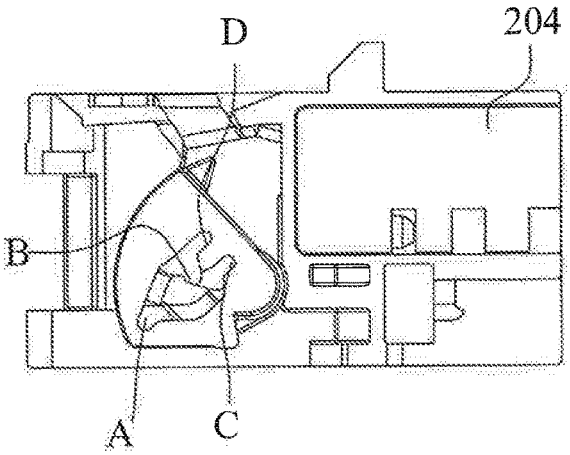

FIG. 8B-1 is a sectional view of the sliding block 204, showing the internal structural and the state diagram of the sliding block 204 when the door hook 101 in the present disclosure is inserted into the cam 201 and the door is pulled from the outside (or the door is pushed from the inside of the door). FIG. 8B-2 is a schematic diagram of a relative position between the pin 303 and the heart shaped groove 411 of the rocking block 401 in the state as shown in FIG. 8B-1.

It should be noted that when applying a pull force to the door from the outside or applying a push force to the door from the inside, the acting point between the door and the door lock 100 will be transmitted to the door hook 101, and these two forces have the same acting direction to the cam 201. Therefore, both of the door opening manners may be described using FIG. 8B-1 and FIG. 8B-2.

When applying a pull force from the outside of the door (or starting to apply a push force to the door from the inside of the door), under the action of the pull force (or internal push force), the door hook 101 mounted on the door pulls the cam 201 to rotate clockwise, and the clockwise rotation of the cam 201 pushes the sliding block 204 to move to the right. Because the rocking block 401 is in a caught state at this moment, the movement of the sliding block 204 to the right causes the rocking block 401 to have a tendency of rotating clockwise about the shaft 605, such that the roller 402 generates a counteraction force to counterclockwise rotate the stepped protrusion 410, thereby pressing the spring 407 in the roller 402. When the pull force applied to the door from the outside of the door (or the push force applied to the door from the inside of the door) overcomes the elastic force of the spring 407, the roller 402 is pressed into the receiving cavity 430, such that the stepped protrusion 410 no longer blocks the movement of the rocking block 401, which makes the rocking block 401 in the rotatable state. Consequently, the sliding block 204 drives the rocking block 401 to rotate clockwise about the axis 605. In this way, the rocking block 401 rotates from the position of FIG. 8A-1 to the position of FIG. 8B-1. The pin 303 leaves the recessed portion 450 position of point B and turns back to point A from point B in the heart shaped groove 411. Because the pin 303 at point A does not block movement of the sliding block 204, the sliding block 204 releases the cam 201. Under the action of the torsion spring 210, the cam 201 rotates clockwise to the release position.

Figure 9A:
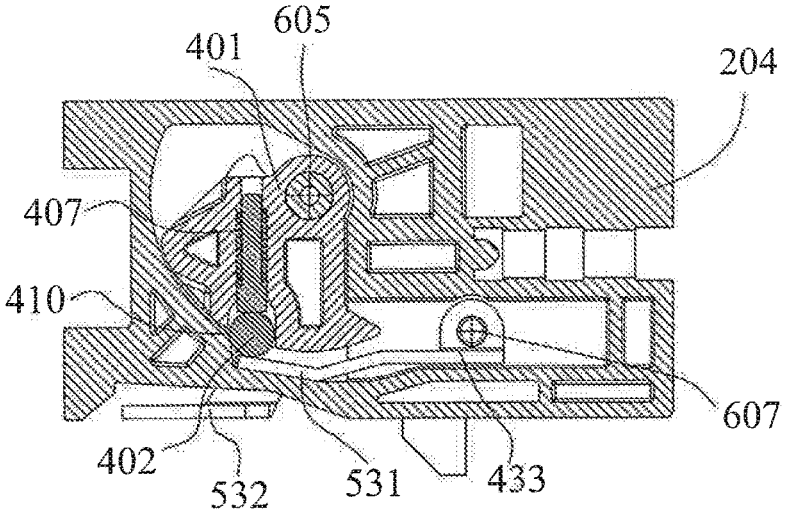
FIGS. 9A, 9B and 9C are three sectional views of the sliding block 204 according to the present disclosure, showing a schematic diagram of a process in which the actuator 103 actuates the rocking block 401 to rotate to unlock during an automatic unlocking process.
Figure 9B:
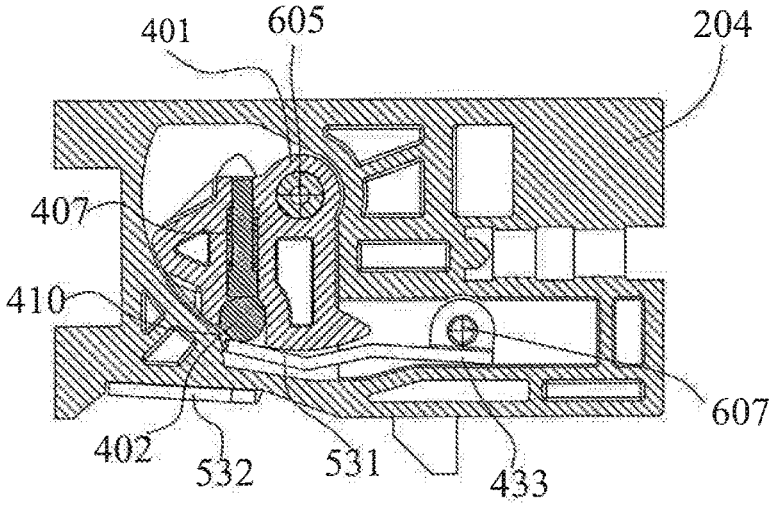
Figure 9C:
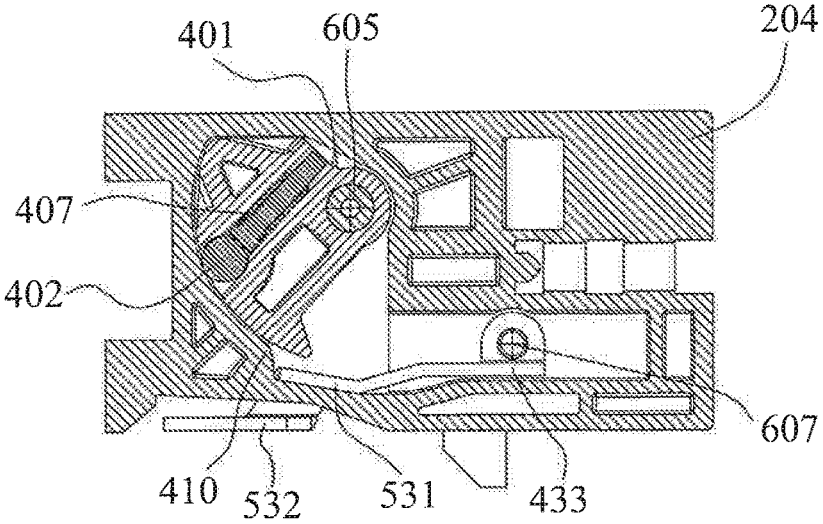

FIGS. 9A, 9B and 9C are three sectional views of the sliding block 204 in the present disclosure, showing a schematic diagram of a process in which the actuator 103 actuates the rocking block 401 to rotate to unlock during an automatic unlocking process.

FIG. 9A shows a state diagram when the rocking block 401 is caught by the stepped protrusion 410, where the structures of respective components in the door hook 101 and the door lock 100 are identical to those in FIG. 7C-1.

As shown in FIG. 9B, during automatic unlocking, the actuator 103 receives an actuating signal and the coil 104 inside the actuator is energized to generate an electromagnetic force which drives the iron core 122 to elect the contact needle 123. The contact needle 123 starts to push the front end 532 of the operating rod 433 to make the operating rod 433 to rotate about the shaft 607 to gradually apply a pressing force to the roller 402 so as to overcome the elastic force of the spring 407.

As shown in FIG. 9C, when the force applied by the operating rod 433 to the roller 402 overcomes the elastic force of the spring 407, the roller 402 rolls over the stepped protrusion 410 to cause the rocking block 401 to be out of the engagement restriction. Meanwhile, under the action of the torsion force of the torsion spring 201, the cam 201 is driven to rotate clockwise, and then the cam 201 further pushes the sliding block 402 to move to the right. Because the pin 303 is located at the recessed portion 450 at the point B of the heart shaped groove of the rocking block 401, the pin 303 cannot move along the length direction of the sliding block 402. Therefore, the movement of the sliding block 402 forces the rocking block 401 to rotate clockwise about the shaft 605, such that the pin 303 directly moves from point B to point A (without going through point C or point D) relative to the position of the heart shaped groove 411, and the door lock is unlocked. This approach is automatic unlocking of the electric appliance, which implements automation of opening the door of the electric appliance, meeting the trend of smart appliances.

Figure 10A:
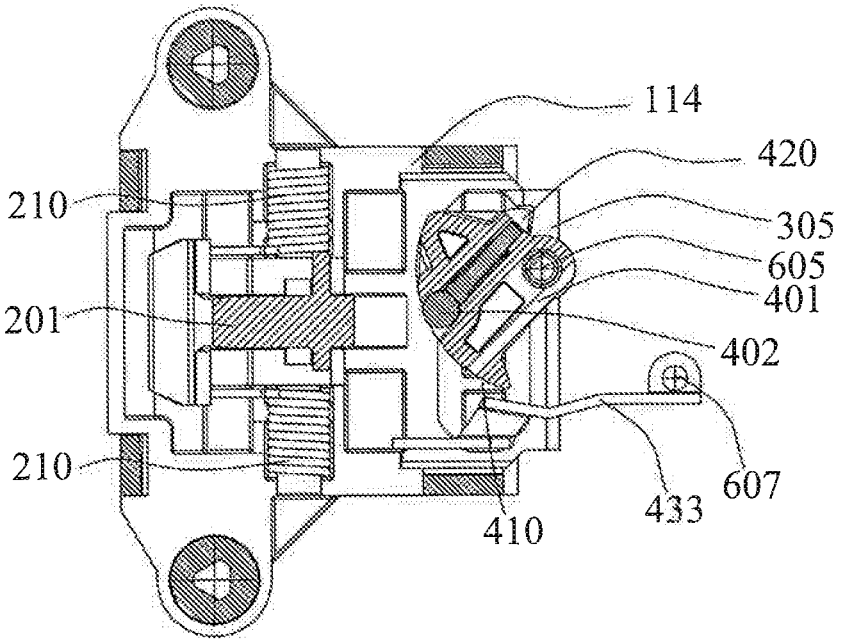
FIGS. 10A and 10B are transverse sectional views of the base 114 and the rocking block 401 according to the present disclosure, showing a state diagram when the rocking block 401 returns to the position where it is not eccentrically rotated after rotation.
Figure 10B:
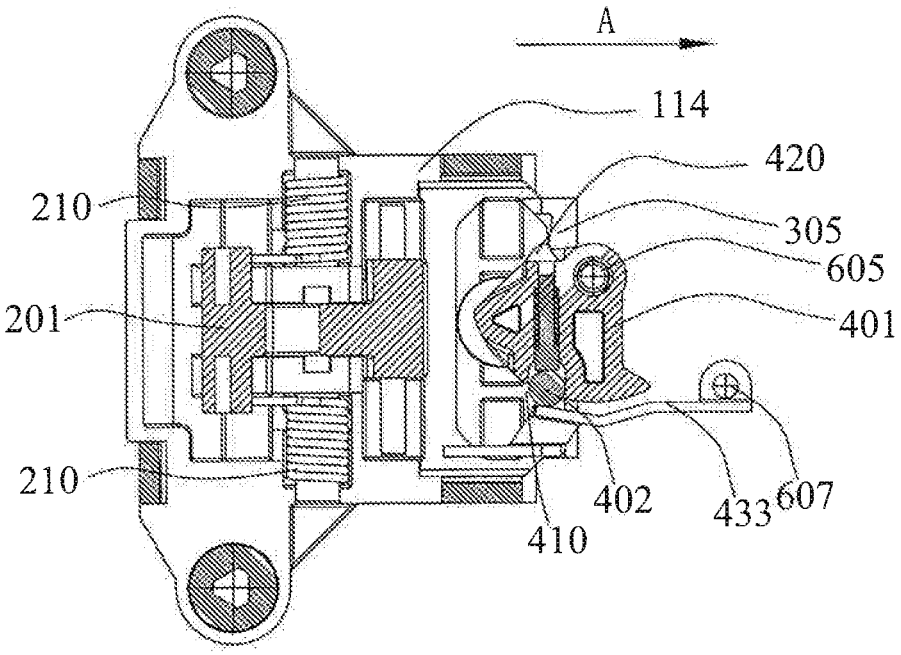

FIGS. 10A and 10B are transverse sectional views of the base 114 and the rocking block 401 in the present disclosure, showing a state diagram when the rocking block 401 returns to a position in which it is not eccentrically rotated after rotation.

The positions of the components shown in FIG. 10A correspond to those in the state diagram as shown in FIG. 8B-1 or FIG. 9C after the rocking block 401 rotates counterclockwise upon external force unlocking or electromagnetic unlocking. As shown in FIG. 10A, when the unlocking action is completed (i.e., the roller 402 is retracted into the rocking block 401), the rocking block 401 may be released from the restriction from the pin 303 and rotate freely. As a result, the sliding block 204 loses the original support force from the pin 303. The torsion springs 210 on the cam 201 shaft forces the cam 201 to rotate to the door opening position, and pushes the sliding block 402 via the cam shaft 211 to the right relative to the base 114 or towards a direction away from the cam 201 (direction A in the figure) to move to a position in the door opening state. In FIG. 10A, the roller 402 on the rocking block 401 leaves the engaging step 410 in the sliding block receiving cavity 431; however, the raised portion 420 on the rocking block 401 contacts or is close to the protrusion 305 on the sliding block 204. The cam shaft 211 in FIG. 10A is the pushing means on the cam 201 for pushing the sliding block 402.

As shown in FIG. 10B, when the sliding block 204 moves to the right (towards the direction away from the cam 201) relative to the base 114, the relative movement between the sliding block 204 and the base 114 causes the protrusion 305 on the base 114 to poke the raised portion 420 of the rocking block 401, driving the rocking block 401 to rotate counterclockwise, thereby poking the rocking block 401 back to the position in which the roller 402 faces the raised step 410 and the rocking block 401 is caught again. Consequently, the pin 303 returns to point A position of the heart shaped groove 411. Almost simultaneously, the sliding block 204 and the cam 201 are reset (i.e., the position in the door opening state) as well.

Figure 11:
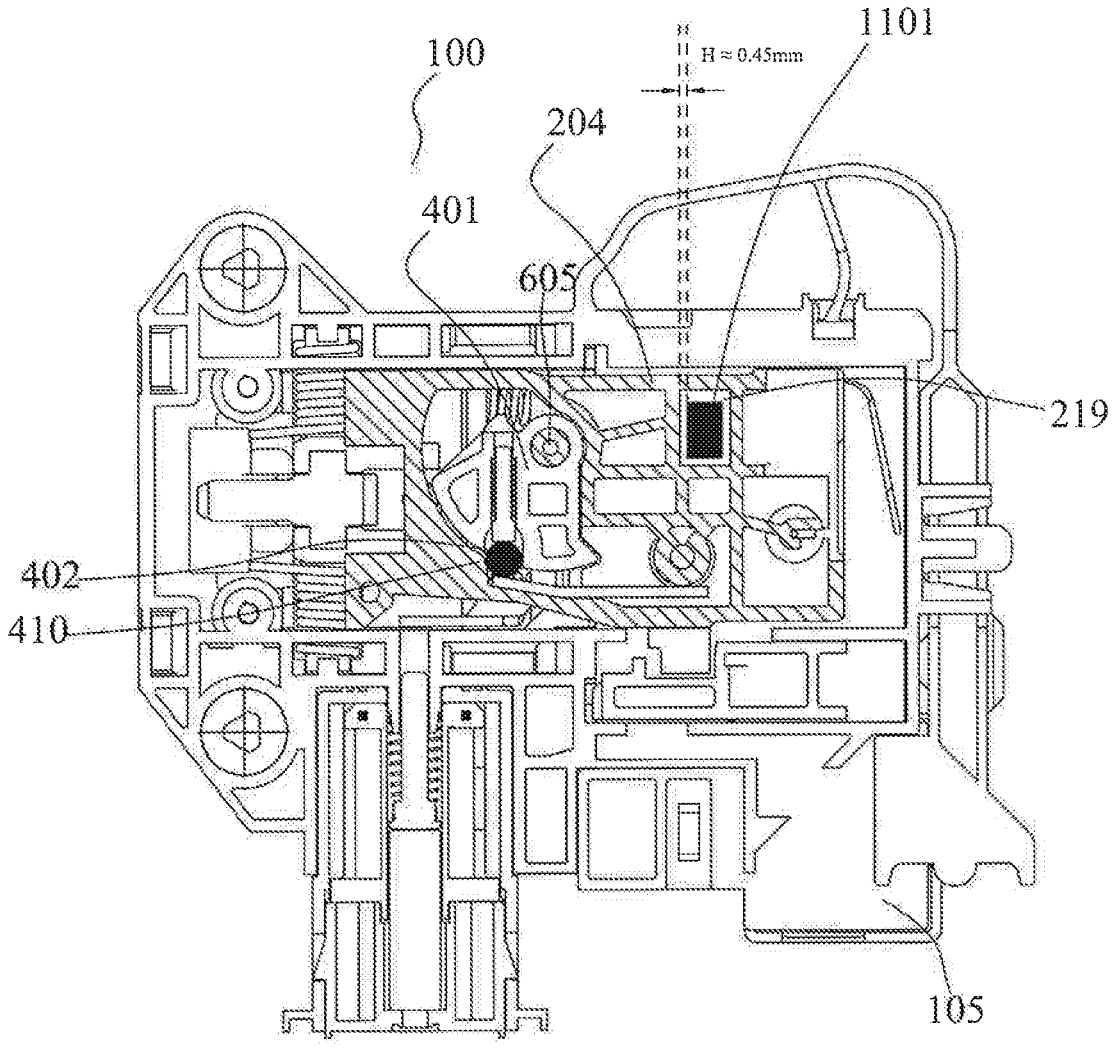
FIG. 11 is a transverse sectional view of the door lock 100, showing a positional relationship between the sliding block 204 and a locking block 1101 in the switch box 105 when the door lock 100 is in a locked state.

FIG. 11 is a transverse sectional view of the door lock 100, showing a positional relationship between the sliding block 204 and the locking block 1101 in the switch box 105 when the door lock 100 is in the locked state.

In the door lock 100 as shown in FIG. 11, when the door of the electric appliance is closed normally, the door hook 101 is caught by the cam 201, while the back side of the cam 201 is abutted by the sliding block 204. With reference to FIG. 2, the switch box 105 is disposed below the sliding block 204; therefore, when the locking block 1101 projects upward from the switch box 105, it is inserted into the locking hole 219 on the sliding block 204, thereby locking the cam 201. At this point, the roller 402 is caught on the step 410, such that the rocking block 401 is in the non-rotatable state. In FIG. 11, a gap H exists between a hole wall of the locking hole 219 on the sliding block 204 and the locking block 1101. In the present embodiment, the distance of the gap may be 0.45 mm. This gap H is desired for normally inserting the door lock 100 into the locking hole 219. However, due to existence of the gap, when the door hook 101 is abruptly pulled outward by an external force, the cam 201 will suddenly push the sliding block 204 to move rightward (along the direction away from the cam 201). Such sudden push may apply an impact force to the pin 303, generating an adverse influence on the pin 303.

Figure 12A:
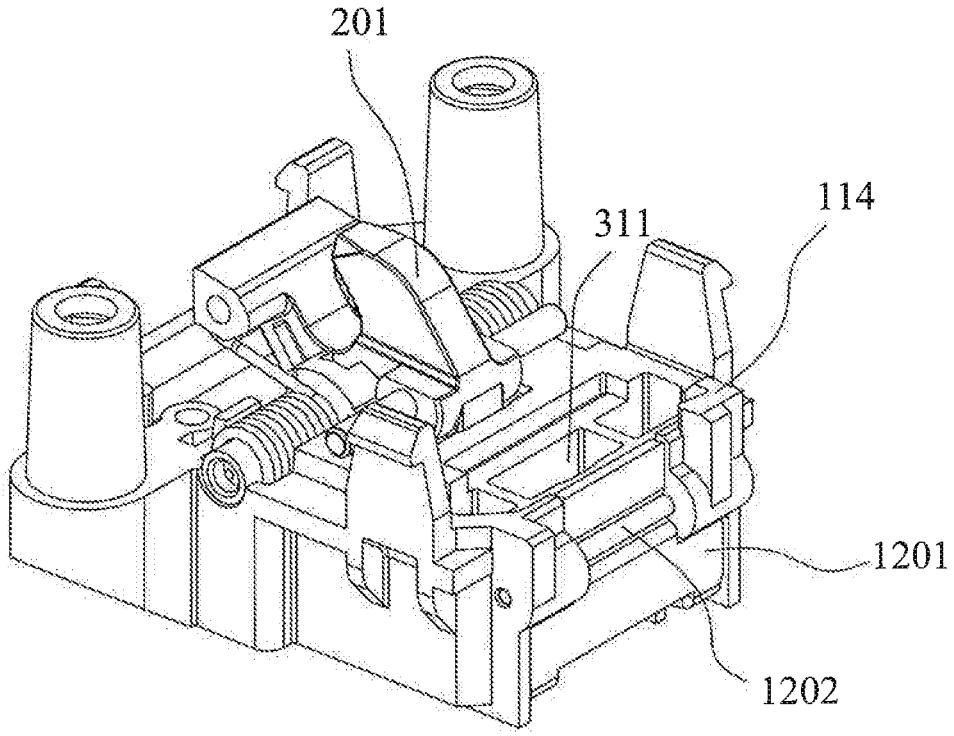
FIG. 12A and FIG. 12 B is a structural perspective view of the base 114 and a structural explosive view of FIG. 12A, respectively, showing a buffer mechanism provided for the gap H in FIG. 11.
Figure 12B:
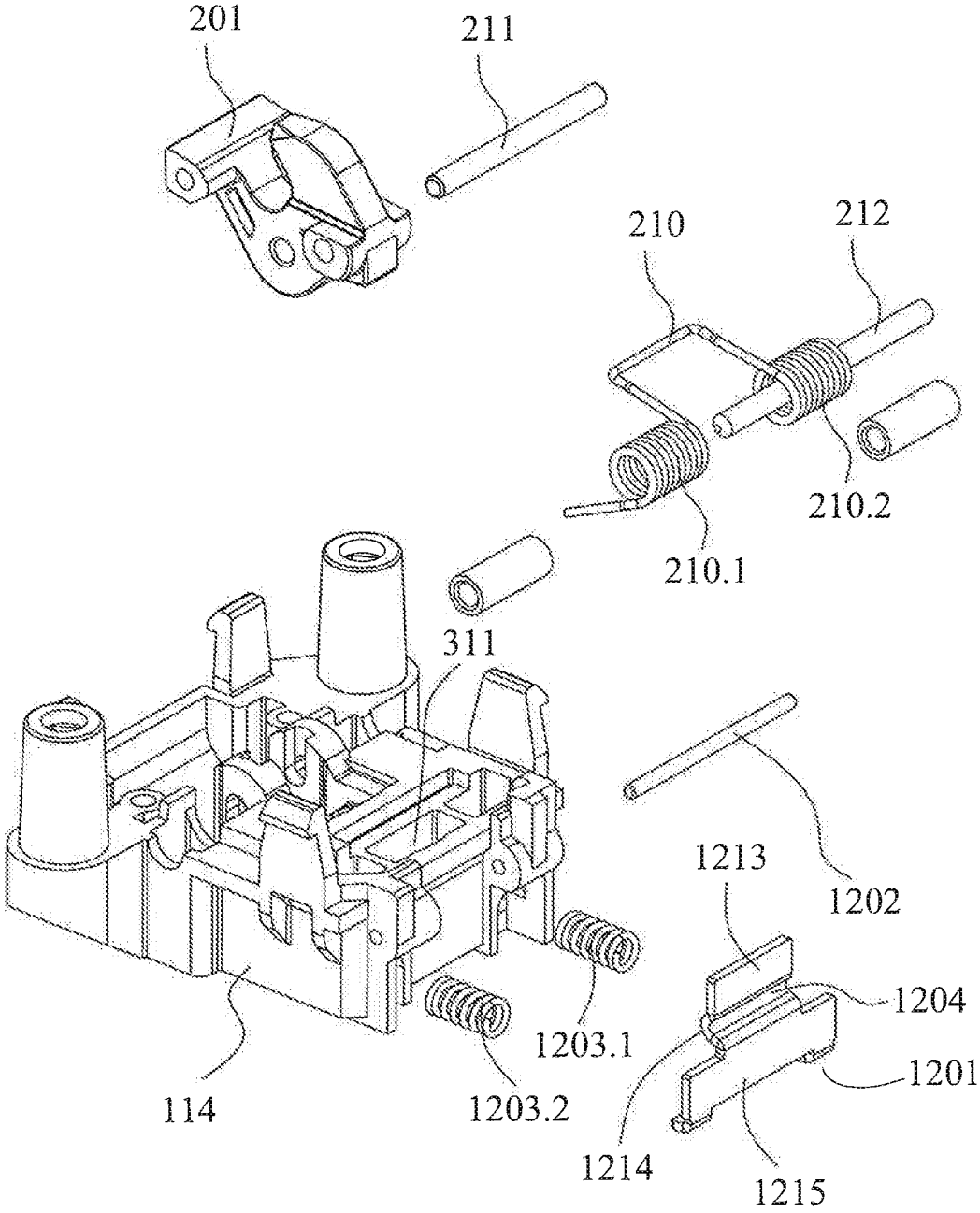

FIG. 12A and FIG. 12B is a structural perspective view of the base 114 and a structural explosive view of FIG. 12A, respectively, for showing a buffer mechanism provided for the gap H in FIG. 11.

As shown in FIGS. 12A and 12B, the buffer mechanism comprises a lever plate 1201 disposed at an end portion of the base 114, a lever shaft 1202, and a pair of lever springs (1203.1, 1203.2). The lever plate 1201 comprises an upper portion 1213, a middle portion 1214, and a lower portion 1215. The lever plate 1201 is vertically disposed at a tail of the base 114, with the upper portion of the lever plate 1201 being close to the edge of a round disc 321 of the sliding plate 302. The back side of the middle portion 1214 of the lever plate 1201 is bent into an indentation 1204 for receiving the lever shaft 1202; therefore, under the action of the elastic force of the lever springs (1203.1, 1203.2), the lever plate 1201 may rotate a certain angle about the lever shaft 1203 to make the upper portion 1213 of the lever plate 1201 close to or abut against the edge of the round disc 321, such that the lever springs (1203.1, 1203.2) can provide a biasing force to the round disc 321.

Figure 13A:
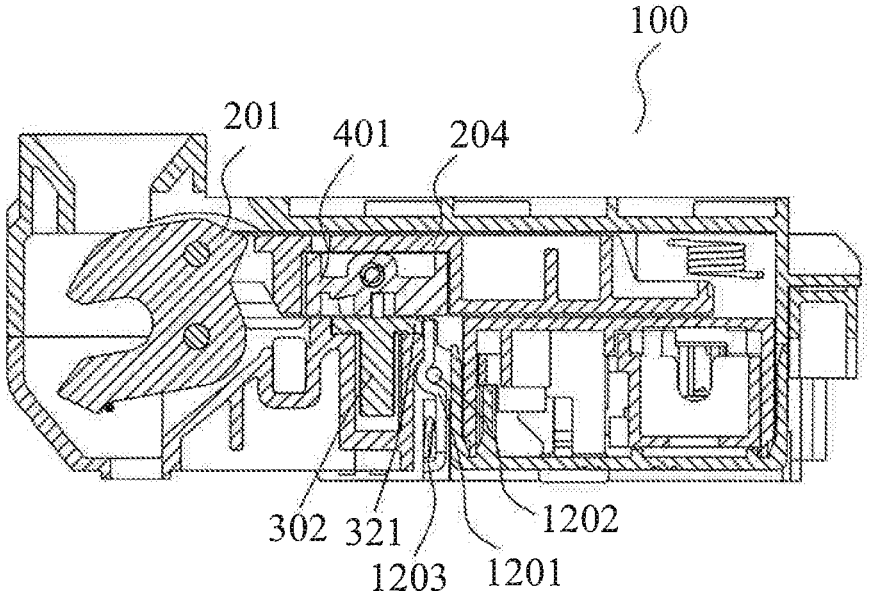
FIGS. 13A and 13B are sectional views of the door lock 100, for illustrating the working process of the buffer mechanism in FIGS. 12A and 12B.
Figure 13B:
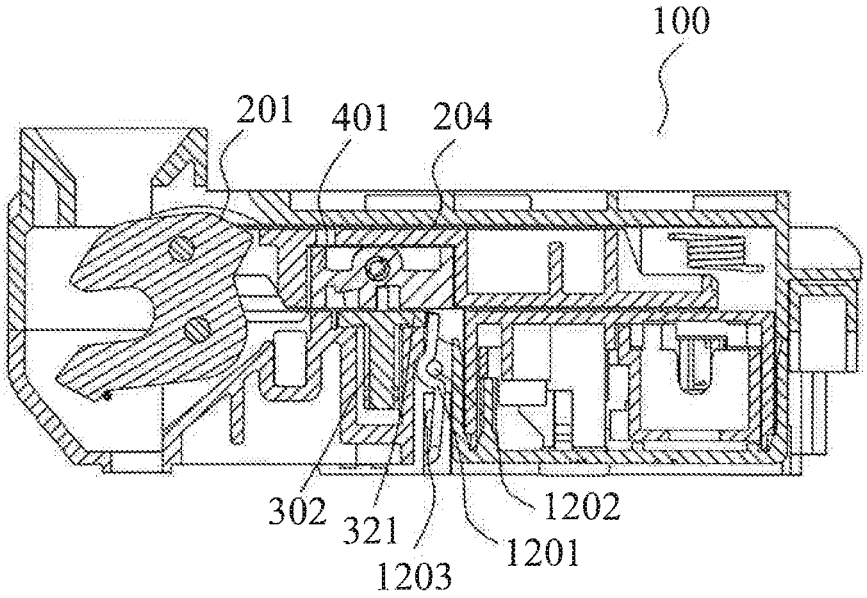
Figure 13C:
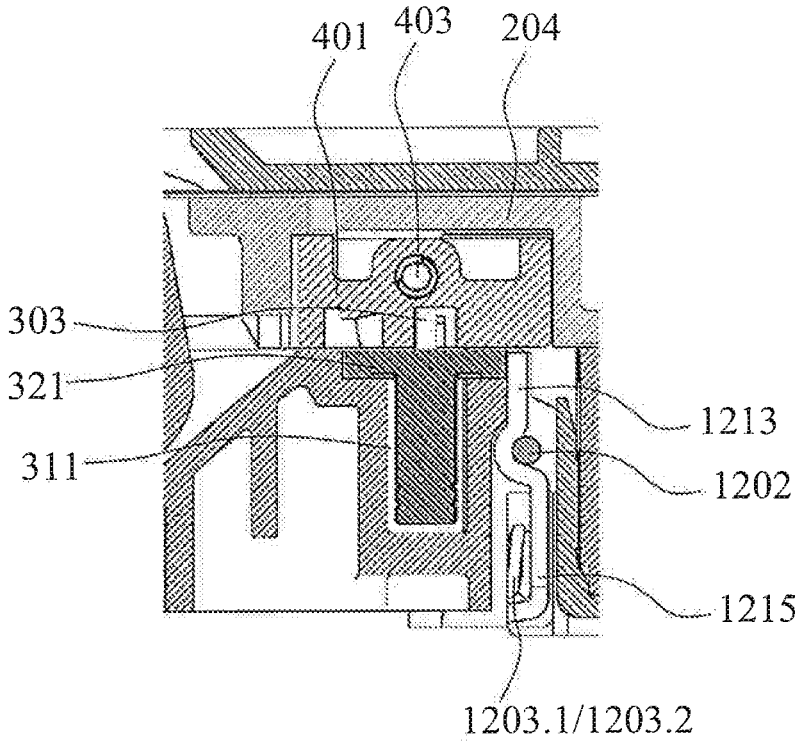
FIGS. 13C and 13D are partial enlarged views of FIGS. 13A and 13B, respectively, showing more details of the working process of the buffer mechanism.
Figure 13D:
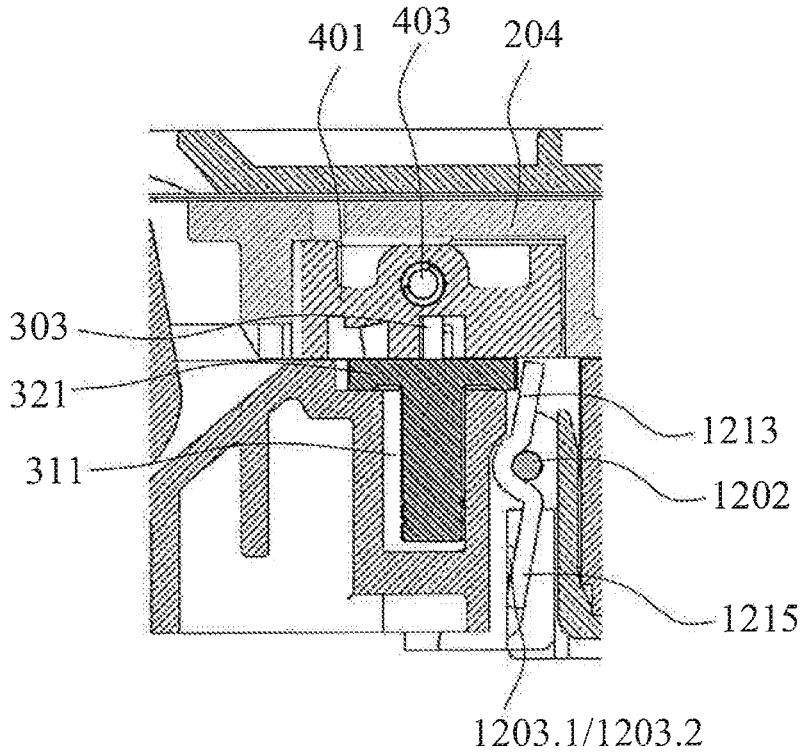

FIGS. 13A-13B are sectional views of the door lock 100, for illustrating the operating process of the buffer mechanism in FIGS. 12A and 12B. FIGS. 13C-13D are partially enlarged views of FIGS. 13A-13B, respectively, showing more details of the operating process of the buffer mechanism.

FIGS. 13A and 13C show positional relationships among the relevant components after closing the door and in the circumstance that no external pull force or internal pull force is applied. As illustrated in FIG. 13A and FIG. 13C, due to an outward elastic force of the lever springs (1203.1, 1203.2) at the bottom, a tendency of the lever strip 1201 rotating counterclockwise about the lever shaft 1203 makes the upper portion 1213 of the lever plate 1201 close to an edge of the round disc 321. A gap exists between the edge of the round disc 321 and the upper portion 1213 of the lever plate 1201, such that sliding of the sliding plate 302 in the transverse groove 321 will not be blocked. At this point, since the rightward push force of the torsion spring 210 on the cam 201 does not suffice to overcome the elastic force of the lever springs (1203.1, 1203.2), the sliding plate 302 is restricted from a longitudinal movement by the upper portion 1213 of the lever plate 1201.

FIGS. 13B and 13D show positional relationships among the relevant components when the door hook is abruptly pulled outward by an external force after the door is closed. As shown in FIG. 13D, by means of the push force pushing the sliding block 204 rightward generated by the torsion spring 210 on the cam 201 and the pull force for pulling the door, the sliding block 204 moves rightward. At this point, the rightward push force of the torsion spring 210 and the pull force of pulling the door overcome the elastic force of the lever springs (1203.1, 1203.2) such that the edge of the round disc 321 pushes away the upper portion 1213 of the lever plate 1201. Consequently, after the sliding plate 302 moves rightward by (or about) a gap distance H along with the sliding block 204, the locking block 1101 contacts with the hole wall of the locking hole 219 on the sliding block 204 to stop movement of the sliding block 204. Therefore, when the door hook 101 is abruptly pulled outward by an external force, as the sliding block 204 moves rightward (a direction away from the cam 201), the sliding plate 302 will correspondingly move the gap distance H, thereby avoiding or buffering the impact on the pin 303.

According to the buffer mechanism as shown in the figures, displacement that absorbs movement of the sliding block 204 is generated by the lever springs 1203.1, 1203.2, such that the magnitude of the elastic force is easily controlled. Besides, due to the convenience for installation, mass production of the door lock 100 is facilitated. However, in practice, the present disclosure is not limited to the buffer mechanism in the figures. Other mechanisms that facilitate absorption of the movement of the sliding block 204, e.g., an elastic steel wire member, also belong to equivalent designs similar to the buffer mechanism of the present disclosure.

Although the present disclosure is described with reference to the preferred embodiments in the drawings, it should be understood that without departing from the spirit and scope of the present disclosure, the door lock including a buffer mechanism in the present disclosure may have many variations, and the state indication means and sensing sliding blocks in the present disclosure may also be applied to electric appliance door locks of other structures. A person of normal skill in the art will also appreciate that the parameters in the embodiments disclosed in the present disclosure all fall into the spirit and scope of the present disclosure and the claims.

The invention claimed is:

1. A door lock, comprising:

a cam having a notch;

a sliding block abutting against the cam and linearly reciprocating with rotation of the cam along a direction of reciprocation;

a rocking block defining an axis of rotation and mounted on and reciprocating in unison with the sliding block so that the rocking block is rotatably movable about the axis of rotation and linearly moveable along the direction of reciprocation, wherein the rocking block defines a rotatable state in which the rocking block can rotate relative to the sliding block and a non-rotatable state in which the rocking block is prevented from rotating relative to the sliding block;

a rocking block locking mechanism for locking the rocking block to make it non-rotatable relative to the sliding block or releasing the rocking block to make it rotatable relative to the sliding block; and automatic unlocking means for releasing the rocking block locking mechanism.

2. A door lock, comprising:

a cam having a notch a sliding block configured for linear reciprocation and which abuts against the cam to translate rotation of the cam into linear movement of the sliding block along a direction of reciprocation; and a rocking block defining an axis of rotation and mounted on and reciprocating in unison with the sliding block so that the rocking block is rotatably movable about the axis of rotation and linearly moveable along the direction of reciprocation;

wherein the rocking block defines a rotatable state in which the rocking block can rotate relative to the sliding block and a non-rotatable state in which the rocking block is prevented from rotating relative to the sliding block.

3. The door lock according to claim 2, wherein the sliding block reciprocates with rotation of the cam; and the rocking block has a mechanism that selectively retains the cam in the locked position or the unlocked position.

4. The door lock according to claim 3, further comprising:
a rocking block locking mechanism for locking the rocking block to make it non-rotatable or releasing the rocking block to make it rotatable.

5. A door lock, comprising:
a cam having a notch;
a sliding block abutting against the cam and reciprocating with rotation of the cam;
a rocking block mounted on the sliding block, wherein the rocking block defines a rotatable state in which the rocking block can rotate and a non-rotatable state in which the rocking block is prevented from rotating;
a rocking block locking mechanism for locking the rocking block to make it non-rotatable or releasing the rocking block to make it rotatable;
automatic unlocking means for releasing the rocking block locking mechanism; and
wherein the rocking block further comprises:
a heart shaped groove having a first position corresponding to the locked position and a second position corresponding to the unlocked position.

6. A door lock, comprising:
a cam having a notch;
a sliding block abutting against the cam and reciprocating with rotation of the cam;
a rocking block mounted on the sliding block, wherein the rocking block defines a rotatable state in which the rocking block can rotate and a non-rotatable state in which the rocking block is prevented from rotating;
a rocking block locking mechanism for locking the rocking block to make it non-rotatable or releasing the rocking block to make it rotatable;
automatic unlocking means for releasing the rocking block locking mechanism;
wherein the rocking block locking mechanism comprises:
a roller;
a spring guide rod; and
a spring being sleeved on the spring guide rod and providing an elastic force to the roller;
wherein the rocking block has a spring bore; and
wherein the spring, the spring guide rod, and the roller are mounted in the spring bore.

7. A door lock, comprising:
a cam having a notch;
a sliding block abutting against the cam and reciprocating with rotation of the cam;
a rocking block mounted on the sliding block, wherein the rocking block defines a rotatable state in which the rocking block can rotate and a non-rotatable state in which the rocking block is prevented from rotating;
a rocking block locking mechanism for locking the rocking block to make it non-rotatable or releasing the rocking block to make it rotatable;
automatic unlocking means for releasing the rocking block locking mechanism,
wherein:
the sliding block is provided with a receiving cavity, a stepped protrusion being provided in the receiving cavity; and
when a roller extends out of the rocking block and contacts the stepped protrusion, the stepped protrusion engages with the roller to prevent the rocking block from rotating.

8. A door lock, comprising:
a cam having a notch;
a sliding block abutting against the cam and reciprocating with rotation of the cam;
a rocking block defining an axis rotation and mounted on and reciprocating in unison with the sliding block such that the axis of rotation of the rocking block reciprocates in unison with the sliding block, wherein the rocking block defines a rotatable state in which the rocking block can rotate and a non-rotatable state in which the rocking block is prevented from rotating;
a rocking block locking mechanism for locking the rocking block to make it non-rotatable or releasing the rocking block to make it rotatable;
automatic unlocking means for releasing the rocking block locking mechanism;
a sliding mechanism having a pin provided thereon;
wherein a heart shaped groove is provided above the sliding mechanism, and
wherein the pin is inserted into the heart shaped groove, the pin moves between the locked position and the unlocked position in the heart shaped groove.

9. A door lock, comprising:
a cam having a notch;
a sliding block abutting against the cam and reciprocating with rotation of the cam;
a rocking block mounted on and reciprocating in unison with the sliding block, wherein the rocking block defines a rotatable state in which the rocking block can rotate and a non-rotatable state in which the rocking block is prevented from rotating;
a rocking block locking mechanism for locking the rocking block to make it non-rotatable or releasing the rocking block to make it rotatable;
automatic unlocking means for releasing the rocking block locking mechanism;
a sliding mechanism having a pin provided thereon:
wherein a heart shaped groove is provided above the sliding mechanism, and
wherein the pin is inserted into the heart shaped groove, the pin moves between the locked position and the unlocked position in the heart shaped groove;
a base on which the sliding mechanism is mounted;
wherein the rocking block has a raised portion, and the base has a protrusion; and
wherein the raised portion of the rocking block and the protrusion of the base cooperate with each other to restore the rocking block to an eccentrically rotated position.

10. The door lock according to claim 9, wherein:
a torsion spring is provided on the cam, such that when the cam is in the unlocked position, the torsion spring ejects the door hook.

11. The door lock according to claim 2, further comprising:
automatic unlocking means, wherein when actuated by a signal, the automatic unlocking means enable the cam to move from the locked position to the unlocked position.

12. The door lock according to claim 6, wherein the automatic unlocking means comprises:
an operating rod for pressing the roller on the rocking block into the interior of the rocking block; and
an actuator for actuating the operating rod.

13. The door lock according to claim 9, wherein the door lock further comprises:
a reset spring mounted on the sliding block for resetting the sliding block,
wherein the elastic force of the torsion spring on the cam is greater than the elastic force of the reset spring on the sliding block.

14. The door lock according to claim 1, wherein the door lock further comprises:

a buffer mechanism for buffering an external force applied when the door lock is in a locked state.

15. A door lock, comprising:

a cam having a notch;

a sliding block abutting against the cam and reciprocating with rotation of the cam;

a rocking block mounted on the sliding block, wherein the rocking block defines a rotatable state in which the rocking block can rotate and a non-rotatable state in which the rocking block is prevented from rotating;

a rocking block locking mechanism for locking the rocking block to make it non-rotatable or releasing the rocking block to make it rotatable;

automatic unlocking means for releasing the rocking block locking mechanism;

wherein the door lock further comprises:

a buffer mechanism for buffering an external force applied when the door lock is in a locked state;

wherein the buffer mechanism further comprises:

a lever plate, a lever shaft, and a lever spring; wherein the lever plate comprises an upper portion, a middle portion, and a lower portion;

the back of the middle portion of the lever plate is bent into an indentation for receiving the lever shaft;

the sliding mechanism comprises a sliding plate, the sliding plate having a round disc; and the upper portion is close to an edge of the round disc of the sliding plate.

* * * * *